US005121934A

United States Patent [19]

Decker et al.

[11] Patent Number: 5,121,934

[45] Date of Patent: * Jun. 16, 1992

[54] SUSPENSION MECHANISM FOR CONNECTING CHAIR BACKS AND SEATS TO A PEDESTAL

[75] Inventors: Lloyd B. Decker, Colon; Barron J. Gulliver, Sturgis, both of Mich.; Steven S. Wogoman, Elkhart, Ind.

[73] Assignee: The Harter Corporation, Sturgis, Mich.

[ * ] Notice: The portion of the term of this patent subsequent to Mar. 27, 2007 has been disclaimed.

[21] Appl. No.: 713,675

[22] Filed: Jun. 11, 1991

Related U.S. Application Data

[60] Division of Ser. No. 463,241, Jan. 9, 1990, Pat. No. 5,046,780, which is a continuation-in-part of Ser. No. 364,996, Jun. 9, 1989, Pat. No. 4,911,501.

[51] Int. Cl.[5] ..... A47C 1/024

[52] U.S. Cl. ..... 297/300; 297/304; 297/306

[58] Field of Search ..... 297/285, 296, 300–304, 297/316, 325, 326, 355, 361, 306

[56] References Cited

U.S. PATENT DOCUMENTS

| | | | |
|---|---|---|---|
| 3,989,297 | 11/1976 | Kerstholt | 297/300 |
| 4,411,469 | 10/1980 | Drabert et al. | 297/300 |
| 4,575,150 | 3/1986 | Smith | 297/30 X |
| 4,744,600 | 5/1988 | Inoue | 297/326 |
| 4,758,045 | 7/1988 | Edel et al. | 297/300 |
| 4,889,335 | 12/1989 | Chadwick et al. | 297/301 X |

*Primary Examiner*—Peter R. Brown

*Attorney, Agent, or Firm*—Renner, Kenner, Greive, Bobak, Taylor & Weber

[57] ABSTRACT

A suspension mechanism (10, 310, 410, 510 and 610) utilized to interconnect the seating portion (16) as well as the back supporting portion (18) of a chair assembly (12, 312,412, 512 or 612) to a pedestal assembly (14). A support (30, 430, or 530) is fastened to the upper end portion of the pedestal assembly (14). A connector, in the form of a primary seat spring (40), or a rigid, connecting plate (513), is secured to the support (30, 430 or 530) and extends generally upwardly and rearwardly therefrom to be secured to the underside of a seating portion (16). An interactive spring (60 or 660) may also be secured to the support (30, 430 or 530). The interactive spring (60 or 660) extends outwardly from the support (30, 430 or 530) in generally parallel relation with the connector (40 or 513) to be disposed in a cantilevered fashion therebetween. The back supporting portion (18) may include a back cushion assembly (102) that is structurally carried by a stanchion (90, 390, 490 or 690) that may be fixedly, or pivotally, secured to the seating assembly (16). When the stanchion (90, 390, 590 or 690) is pivotally mounted, a follower (130) may be presented from the stanchion (90, 390, 590 or 690) operatively to engage the interactive spring (60 or 660). A main back spring (140) may also be secured to the stanchion (90 or 590) to interact against the undersurface (146) on the seating pan (72) of the seating portion (16). One or more lock-out assemblies (150) may be utilized to effect immobilization of the back supporting portion (18) with the seating portion (16) and/or the seating portion (16) with respect to the pedestal assembly (14) if those components are not permanently affixed to each other or are not manually adjustable with respect to each other.

3 Claims, 16 Drawing Sheets

FIG. 4
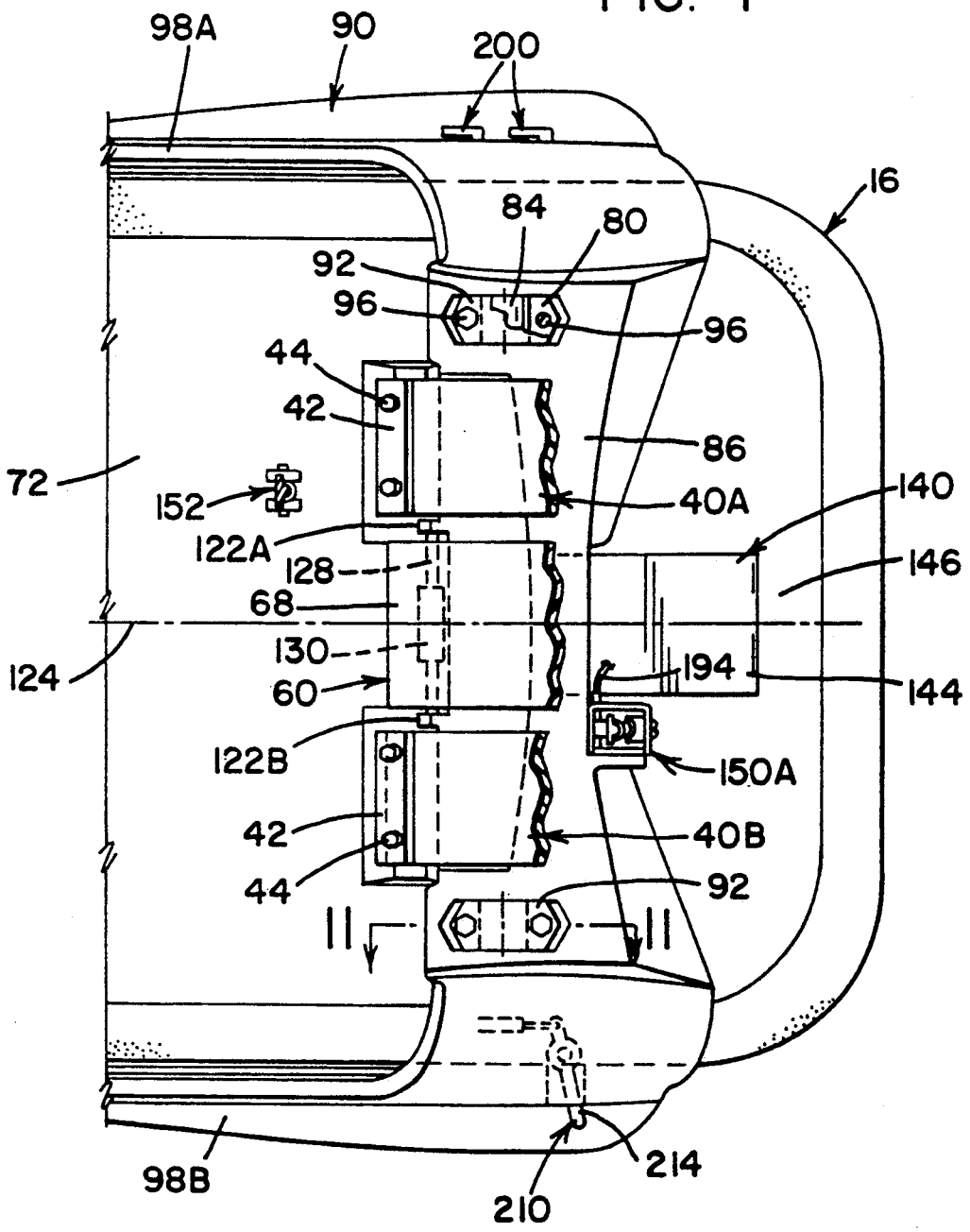
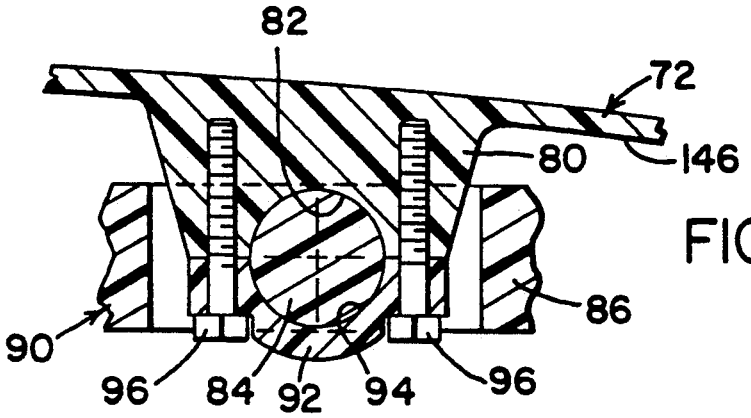
FIG. 11

SUSPENSION MECHANISM FOR CONNECTING CHAIR BACKS AND SEATS TO A PEDESTAL

This application is a division of application Ser. No. 07/463,241 filed on Jan. 9, 1990, and issued as U.S. Pat. No. 5,046,780 on Sep. 10, 1991, which is a continuation in part of application Ser. No. 07/364,996 filed on Jun. 9, 1989, and issued as U.S. Pat. No. 4,911,501 on Mar. 27, 1990.

TECHNICAL FIELD

The present invention relates generally to chair constructions. More particularly, the present invention relates to a suspension mechanism for connecting the seating portion of an office chair to a pedestal assembly and for selectively connecting the back supporting portion to the seating portion. Specifically, the present invention relates to a suspension mechanism which may be utilized selectively to provide movement of the seating portion with respect to the pedestal assembly with, or without, relative movement of the back supporting portion with respect to the seating portion, or the suspension mechanism may be utilized to provide relative movement of the back supporting portion with respect to the seating portion when the seating portion is either fixed, or relatively movable, with respect to the pedestal assembly. The aforesaid relative movement of either the back supporting portion with respect to the seating portion or the seating portion with respect to the pedestal assembly may be determined either by controls which act upon the relatively moveable members or by structural variations to the suspension mechanism. Moreover, when combined movement of the seating and back supporting portions is provided, relative movement of the back supporting portion relative to the seating portion is accomplished without any restrictive requirement for synchronization therebetween.

BACKGROUND OF THE INVENTION

The prior art is replete with structural arrangements for connecting seating portions and back supporting portions to pedestal assemblies. Historically, the seating portion of an office chair was fixedly secured to the upper end portion of a pedestal assembly. The back supporting portion was sometimes also rigidly secured to either the pedestal assembly or the seating portion, and sometimes the back supporting portion was permitted to swing rearwardly, to at least some predetermined degree, in order to permit the person seated in the chair to lean back against the resistance of a biasing mechanism incorporated between the back supporting portion and either the pedestal assembly or the seating portion.

Eventually office seating manufacturers also mounted the seating portion to the pedestal assembly with mechanism that would permit selective rearward tilting of the seating portion. In such constructions the seating portion was generally mounted on pivot axles presented from the pedestal assembly, with variously adjustable spring means being utilized to provide the desired resistance to the tilting action of the seating portion. Here, too, the back supporting portion was initially disposed to be fixed in relation to the seating portion. As the construction of office chairs was refined, the back supporting portion was permitted to swing with respect to the seating portion, but generally only in synchronized relation to the tilting movement of the seating portion. For example, if the seating portion were permitted to tilt through a fixed number of degrees, the back supporting portion was permitted to be swung only a given number of degrees in relation to the number of degrees through which the seating portion was tilted. Hence, when the seating portion was tilted, the back support would generally swing through an incremental range that was mathematically fixed in relation to each degree through which the seating portion was being tilted.

Moreover, in those prior art arrangements wherein the back supporting portion was permitted to swing with respect to the seating portion, the axis about which the back supporting portion was permitted to swing was generally located in proximity to the rear of the seating portion. As such, when the person seated in the chair leaned back, the back supporting portion would "scrub" against the clothing being worn by the person seated in the chair. Although this scrubbing action was not serious, during the course of several hours the shirt, or blouse, being worn by the person using the chair could be extricated from the mere frictional support by which it was held at the waist.

Over the years adjustments to the spring action against which the person could tilt the seating portion, and/or swing the back supporting portion, were included. However, it was generally a rather tedious operation to effect the desired adjustment to the resistance provided by the springs.

SUMMARY OF THE INVENTION

It is, therefore, a primary object of the present invention to provide an improved chair suspension mechanism for attaching the back supporting portion to the seating portion and/or for attaching the seating portion to a pedestal assembly.

It is another object of the present invention to provide an improved suspension mechanism, as above, which may utilize a primary seat spring to connect the seating portion to the structure of a spring support that is presented from the pedestal assembly.

It is a further object of the present invention to provide an improved suspension mechanism, as above, wherein an interactive spring may be employed, the interactive spring being cantilevered from the spring support to interact with the back supporting portion, and/or the seating portion, of the chair.

It is still another object of the present invention to provide an improved suspension mechanism, as above, wherein a main back supporting spring may be secured to a stanchion assembly from which the back supporting portion is presented, the back supporting spring, when utilized, interacting with the seating portion.

It is a still further object of the present invention to provide a suspension mechanism, as above, wherein spring engaging, curvilinearly contoured ramp surfaces are employed selectively to change the deflection characteristics of at least selected springs in the suspension mechanism in response to the weight of the individual using the chair.

It is an even further object of the present invention to provide a suspension mechanism, as above, wherein the deflection characteristics of selected spring members may be predetermined with considerable ease.

It is yet another object of the present invention to provide at least one embodiment of a suspension mechanism, as above, wherein the user can conveniently select whether the seating portion will tilt in response to the movement of the person sitting in the chair, and the back supporting portion will be maintained in a fixed angular disposition relative to the seating portion, or whether the seating portion will remain fixedly disposed with respect to the pedestal assembly and the back supporting portion will swing in response to the movement of the person sitting in the chair.

It is also an object of the present invention to provide a suspension mechanism, as above, wherein the back supporting portion may swing about an axis that precludes scrubbing the cushion presented from the back supporting portion against the person using the chair.

It is an additional object of the present invention to provide a suspension system, as above, which permits the seating portion to tilt forwardly from its normal disposition without requiring that the back supporting portion also swing forwardly.

By virtue of variations in the nature of alternative embodiments on the overall concepts presented by the present invention it is a desirable object of the present invention to provide a suspension mechanism, as above, wherein a manufacturer can conveniently select whether only the seating portion will tilt in response to the movement of the person sitting in the chair, in which case the back supporting portion will be permanently maintained in a fixed angular disposition relative to the seating portion, or whether the seating portion will remain permanently fixed with respect to the pedestal assembly and only the back supporting portion will be permitted to swing in response to the movement of the person sitting in the chair.

These and other objects of the invention, as well as the advantages thereof over existing and prior art forms, which will be apparent in view of the following detailed specification, are accomplished by means hereinafter described and claimed.

In general, a suspension mechanism embodying the concepts of the present invention is utilized to interconnect the seating portion and/or the back supporting portion of a chair to a support means presented from the upper portion of a pedestal assembly. Virtually any pedestal assembly can be employed in conjunction with the present invention inasmuch as the structure of the pedestal assembly is not in the least critical to the present invention. Connecting means are secured to the support means on the pedestal assembly, and the connecting means extend generally upwardly and rearwardly from the support means to be secured to the underside of the seating portion. If the seating portion is to be permanently fixed with respect to the pedestal assembly, the connecting means may comprise one or more rigid, connecting plates. However, should one wish to permit the seating portion to tilt with respect to the pedestal portion, a primary seat spring means may be secured to the support means and be disposed to extend generally upwardly and rearwardly therefrom to be secured to the underside of the seating portion. In such an embodiment the primary seat spring preferably comprises a pair of laterally spaced, leaf springs. However, it should be appreciated that in some embodiments only a single leaf spring will be required.

In some embodiments of the present suspension system an interactive spring may also be secured to the support means. An interactive spring, when utilized, is preferably located between a pair of laterally spaced primary seat springs. The interactive spring would, then, preferably extend outwardly from the support means in generally parallel relation with the primary seat springs, but the interactive spring would be disposed in a cantilevered fashion.

The back supporting means may be rigidly secured to, or integrally formed with, the seating portion, or, alternatively, the back supporting portion may be mounted to tilt with respect to the seating portion. In either situation the back supporting portion may include a back cushion that may itself be pivotally presented. When it is desired to permit the back supporting portion to tilt with respect to the seating portion, a stanchion may be pivotally supported from the seating portion of the chair assembly. In such embodiments a follower means will preferably be presented from the stanchion operatively to engage the interactive spring. In addition, a main back supporting spring may also be presented from the stanchion to interact with the seating portion.

One exemplary chair assembly including all the tilting features of a suspension mechanism embodying the concepts of the subject invention—together with four alternative chair assemblies wherein either the back supporting portion is either fixed, or manually adjustable, with respect to the seating portion, or the seating portion is fixed with respect to the pedestal assembly—are shown by way of example in the accompanying drawings and are described in detail without attempting to show all of the various forms and modifications in which the invention might be embodied; the invention being measured by the appended claims and not by the details of the specification.

BRIEF DESCRIPTION OF THE DRAWINGS

FIG. 4 is a horizontal section taken substantially along line 4—4 of FIG. 3 and depicting the seating portion of the chair in bottom plan;

FIG. 11 is an enlarged cross section taken substantially along line 11—11 of FIG. 4 to depict the journal arrangement by which the back supporting portion may be pivotally carried on the seating portion, FIG. 11 appearing on the same sheet of drawings as FIG. 4;

DESCRIPTION OF AN EXEMPLARY EMBODIMENT

Figure 1:
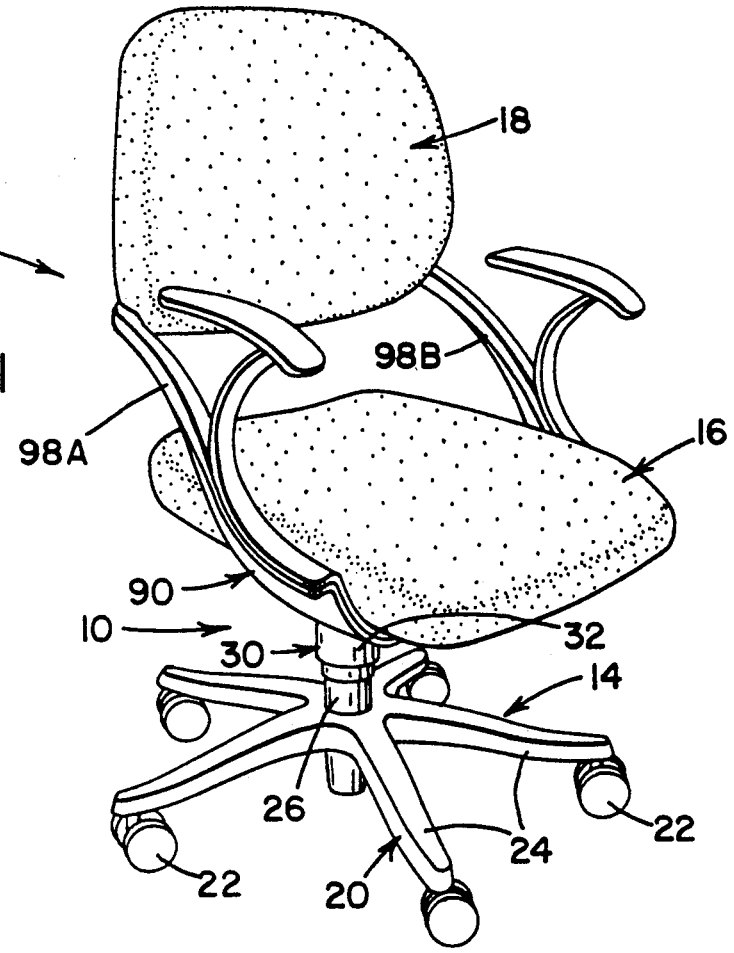
FIG. 1 is a perspective view of a chair embodying the concepts of the present invention.
Figure 2:
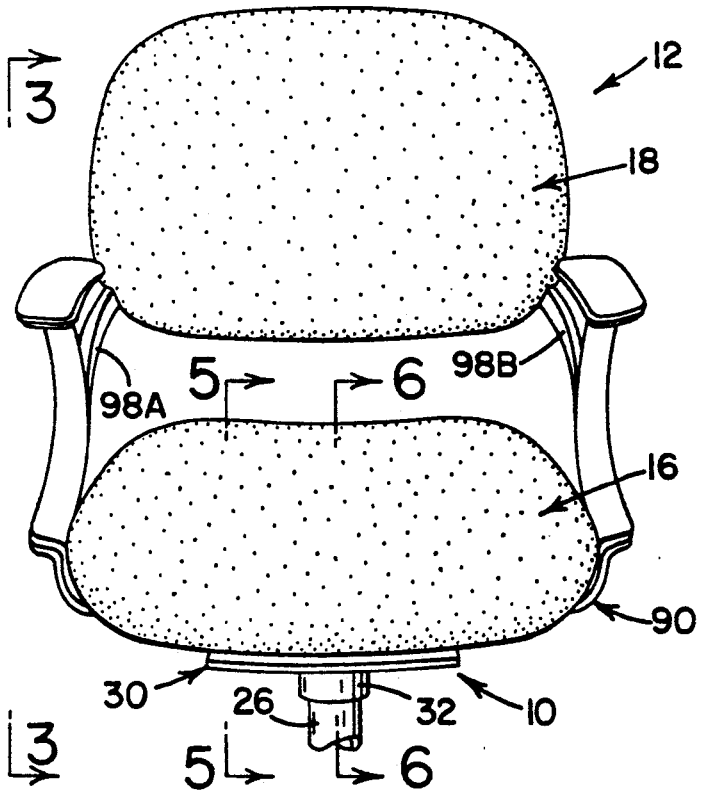
FIG. 2 is frontal elevation of the chair depicted in FIG. 1.

One representative form of a suspension mechanism embodying the concepts of the present invention, and which incorporates all the tilting features possible by virtue thereof, is designated generally by the numeral 10 on the accompanying drawings. The representative suspension mechanism 10 is incorporated in a chair assembly 12, and as seen in FIG. 1, the chair assembly 12 comprises a pedestal assembly 14, a seating portion 16 and a back supporting portion 18. The suspension mechanism 10 is the sole structure interposed between the pedestal assembly 14 and both the seating portion 16 and the back supporting portion 18.

The pedestal assembly 14 may have a conventional, five leg spider, or base, 20 with a caster wheel 22 secured at the outer end of each leg 24 on the spider 20. As is well known, the five legged spider 20 provides stability for the chair assembly 12 when the occupant is moving the chair while seated, or while leaning forwardly, rearwardly, or to the side. These movements are often made, for example, when the occupant desires to retrieve an article without leaving the chair.

Figure 3:
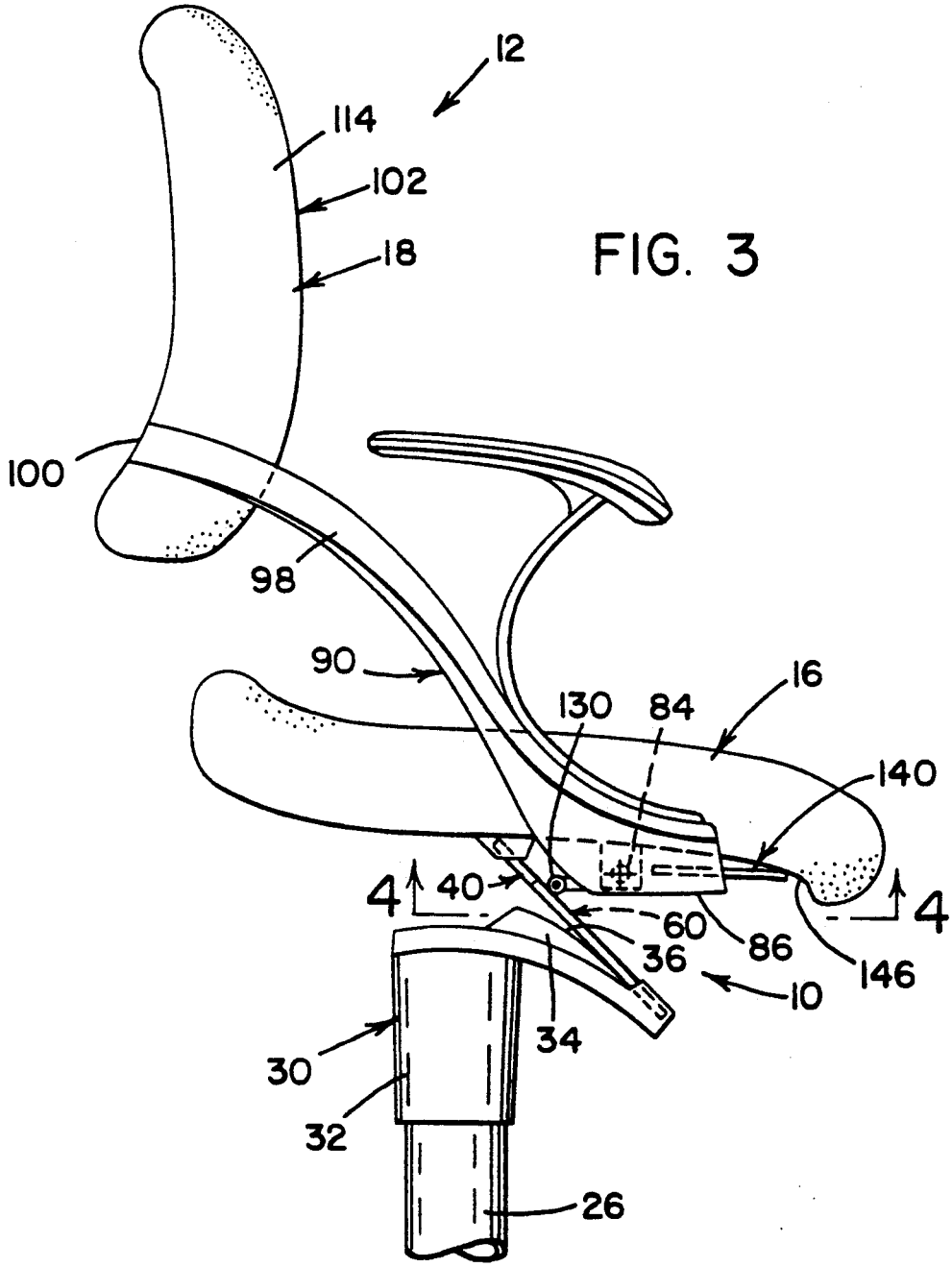
FIG. 3 is a schematic side elevation taken substantially along line 3—3 of FIG. 2.
Figure 5:
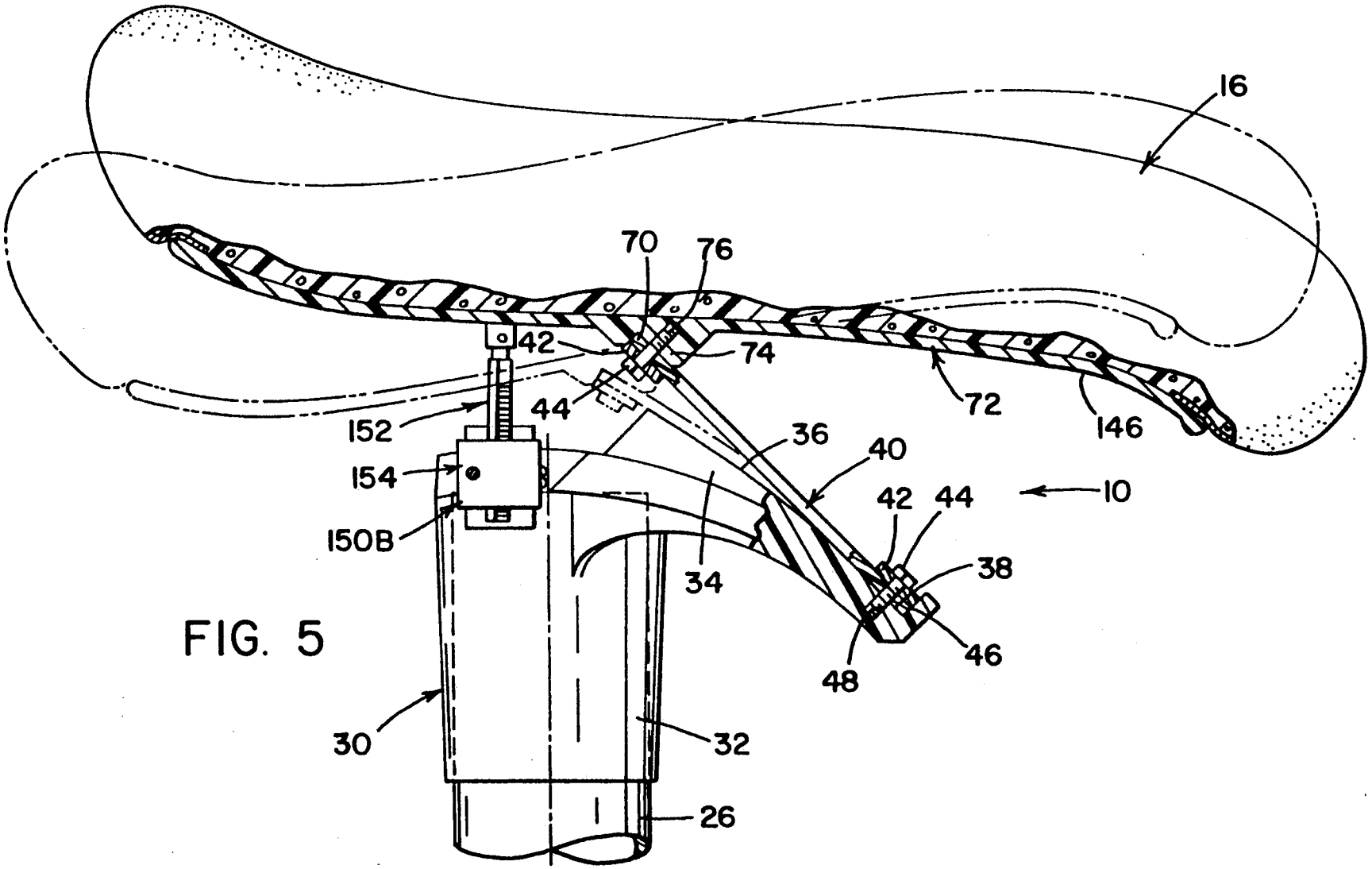
FIG. 5 is a vertical section taken substantially along line 5—5 of FIG. 2 to depict the main seat spring that is connected between the spring support and the pan of the seating portion in the chair depicted in FIGS. 1 and 2 as well as that lock-out assembly which is operative between the seating portion and the spring support.

The pedestal assembly 14 also includes a cylindrical post 26 on the top of which a spring support 30 is secured, as by a cylindrical mounting cup 32 which circumscribes the post 26. The spring support 30 has a pair of laterally spaced, spring engaging ramps 34, the upwardly facing surface 36 of which is curvilinearly contoured, as depicted in FIGS. 3 and 5. Each curvilinearly contoured surface 36 merges into an anchor surface 38. As such, the anchor surfaces 38A and 38B are adjacent the ramps 34A and 34B.

In the detailed description which follows, a particular structural member, component or arrangement may be employed at more than one location. When referring generally to that type of structural member, component or arrangement a common numerical designation shall be employed. However, when one of the structural members, components or arrangements so identified is to be individually identified it shall be referenced by virtue of a letter suffix employed in combination with the numerical designation utilized for general identification of that structural member, component or arrangement. Thus, there are at least two ramps which are generally identified by the numeral 34, but the specific, individual ramps are, therefore, identified as 34A and 34B in the specification and on the drawings. This same suffix convention shall be employed throughout the specification.

A primary seat spring 40 is secured to each of the laterally spaced anchor surfaces 38. To effect attachment of each primary seat spring 40A and 40B to its respective anchor surface 38A and 38B on the spring support 30, individual mounting plates 42 and threaded fasteners 44 may be employed. A mounting plate 42 is disposed to overlie the first end portion 46 of each primary seat spring 40 so the fasteners 44 may pass through appropriate openings in each mounting plate 42 as well as through openings in the first end portion 46 of each primary seat spring 40 and finally into receiving bores 48 in the laterally spaced anchor surfaces 38A and 38B. The primary seat springs 40 are, therefore, securely anchored to the spring support 30, and thereby to the pedestal assembly 14.

Figure 6:
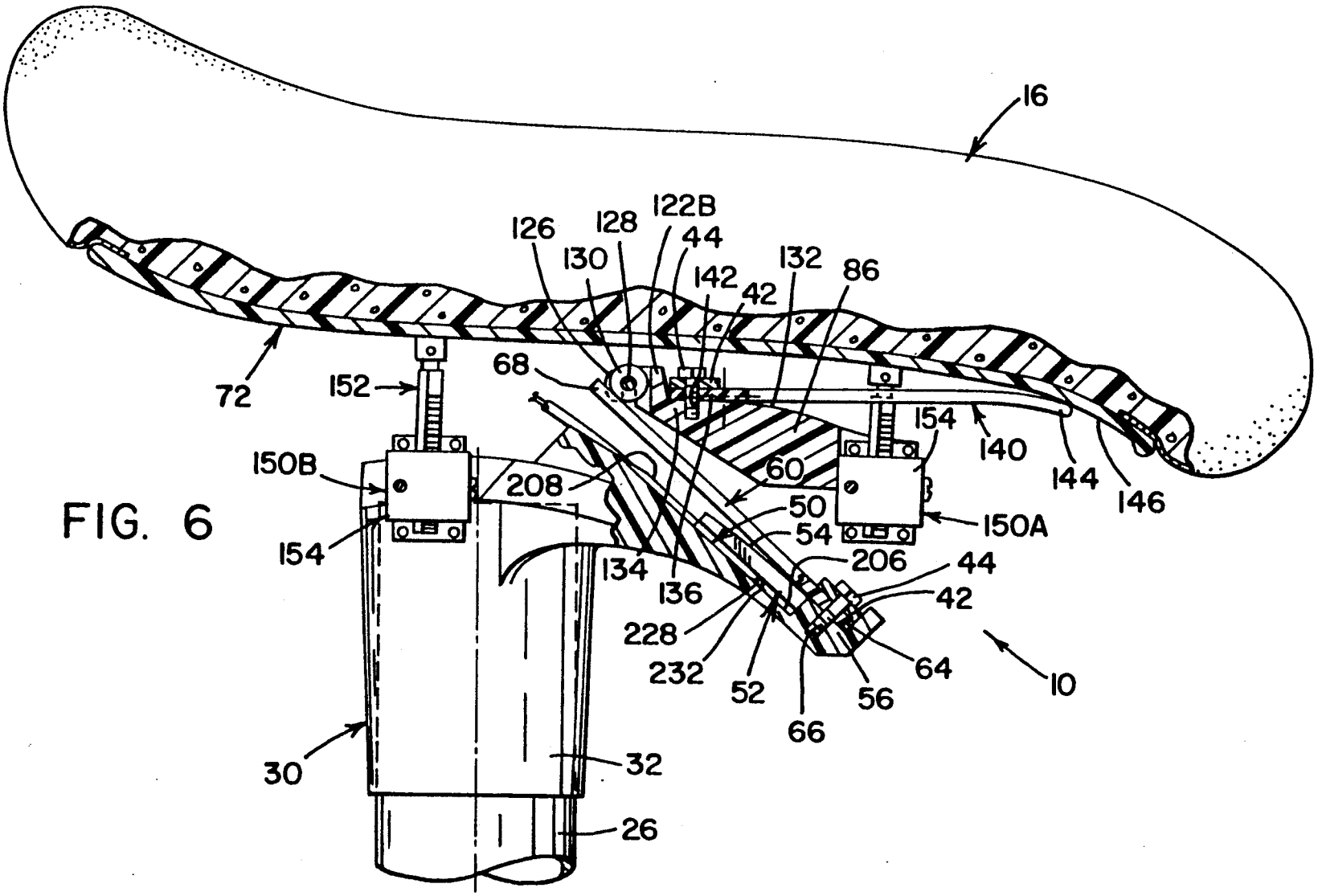
FIG. 6 is a vertical section taken substantially along line 6—6 of FIG. 2 to depict not only the interactive spring that is cantilevered outwardly from the spring support to be operatively engaged by the back supporting portion but also the main back support spring that is secured to the back supporting portion operatively to engage the pan of the seating portion as well as that lock-out assembly which is operative between the seating portion and the stanchion.

A central slideway, or recess, 50, as seen in FIG. 6, houses a movable wedge member 52. The upwardly facing surface 54 on the movable wedge member 52 is also curvilinearly contoured and may be juxtaposed to a centrally located spring anchor surface 56 which is also presented from the spring support 30.

An interactive spring 60 is centrally positioned on the spring support 30 intermediately with respect to the primary seat springs 40A and 40B. The interactive spring 60 is attached to the spring 30 in a manner similar to that used for the attachment on the primary seat springs 40. That is, a mounting plate 42 is disposed to overlie the first end portion 64 of the interactive spring 60, and a pair of threaded fasteners 44 are inserted through appropriate openings provided in the mounting plate 42, through registered bores in the first end portion 64 of the interactive spring 60 and into receiving bores 66 in the central anchor surface 56.

When properly secured to the anchor surfaces 38, each of the primary seat springs 40 are vertically aligned with one of the curvilinearly contoured surfaces 36 on the ramps 34. So aligned, the primary seat springs 40 extend generally rearwardly and upwardly from the respective, laterally spaced anchor surfaces 38. The interactive spring 60, which is located between the laterally spaced primary seat springs 40, is vertically aligned with the central slideway 50 on the spring support 30. The interactive spring 60 extends generally rearwardly and upwardly from the central anchor surface 56. The interactive spring 60 is purposely shorter than the primary seat springs 40, and as such the interactive spring 60 is cantilevered outwardly from the central anchor surface 56 to which the first end portion 64 of the interactive spring 60 is secured. As such, the second end portion 68 of the interactive spring 60 is unsupported.

The second end portion 70 of each primary seat spring 40A and 40B is connected to the seat pan 72 in the seating portion 16 of the chair assembly 12 at anchor surfaces 74A and 74B which align with the lateral anchor surfaces 38A and 38B, respectively, on the spring support 30. Each anchor surface 74 is substantially flat and is provided with a pair of receiving bores 76. The second end portion 70 of each primary seat spring 40 is secured to one of the anchor surfaces 74 by a flat, mounting plate 42 and a pair of preferably threaded fasteners 44 which extend through the mounting plate 42, the second end portion 70 of the respective, primary seat springs 40 and into the receiving bores 76 in the same manner as the end portions of the other spring members have heretofore been described as being secured to their respective anchor surfaces.

The seat pan 72, as seen in FIGS. 4 and 11, has a pair of mounting blocks 80 each having a bearing surface in the configuration of a semi-cylindrical saddle 82. The seat pan 72 is mounted on a pair of laterally spaced, cylindrical journals 84 formed integrally with the base portion 86 of a stanchion 90. A cap 92 having an opposed, semi-cylindrical, bearing surface 94 is secured to each mounting block 80 with one of the journals 84 disposed between the opposed bearing surfaces 82 and 94. A pair of fasteners 96 may be employed to secure each cap 92 to its respective mounting block 80. The journals 84 thus define the pivotal axis about which the stanchion 90 will swing in relation to the seating portion 16.

The fore and aft location of the mounting blocks 80, and thus the journals 84, with respect to the seating portion 16 can enhance the comfort of the chair assembly 12 for the user. For example, FIG. 3 represents the fore and aft location of the journals 84 to be medially between the fore and aft boundary delineated by the connection of the primary seat spring 40 with the spring support 30 and the connection of the primary seat spring 40 with the seating portion 16. This location accomplishes the desired result of allowing the back supporting portion 18 to swing back and forth about virtually the same center of rotation as the person seated on the seating portion 16.

The substantial concentricity for the swinging movement of the back supporting portion 18 and leaning movement of the person using the chair assembly 12 obviates the undesirable scrubbing action historically present between the back supporting portion 18 and the user when the seating portion and the back supporting portion of the chair were both capable of being moved. As can also be observed by reference to FIG. 3, the journals 84 are located approximately one-third the distance from the front of the seating portion 16 to the rear thereof.

The stanchion 90 has a pair of S-curved support arms 98A and 98B which are laterally spaced to lie on either side of the seating portion 16 and which extend between the base portion 86 of the stanchion 90 and a transverse support bar 100, also comprising an integral portion of the stanchion 90. The base portion 86, the support arms 98 as well as the transverse support bar 100 thus combine to form the stanchion 90 of the back supporting portion 18 in the chair assembly 12.

Figure 10:
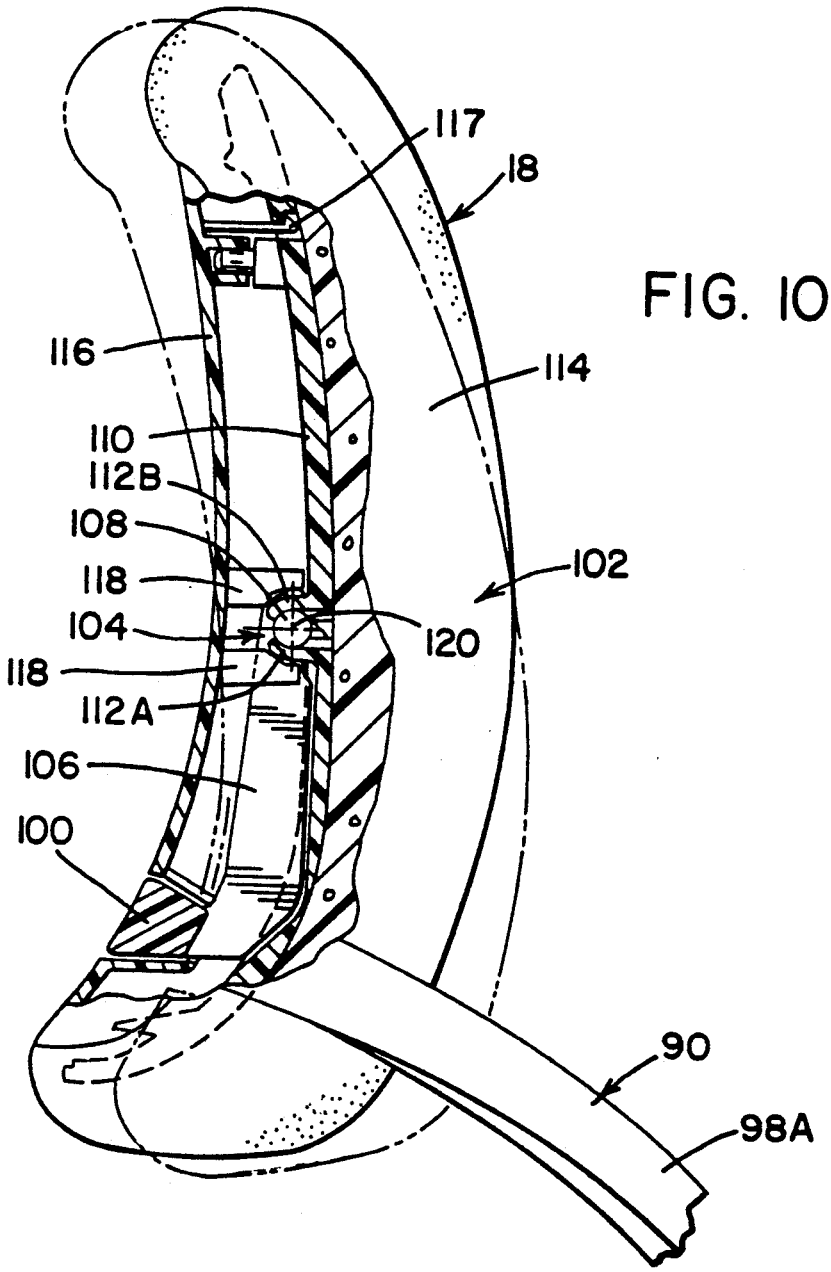
FIG. 10 is an enlarged, side elevation of the back cushion, partly broken away to reveal the interconnection of the cushion with the stanchion.

A back cushion assembly 102 may be pivotally secured to the transverse support bar 100 by a pivot joint 104 that may be hidden within the back cushion assembly 102. As best seen in FIG. 10 (although only on of the arms 106 can be seen), a pair of spacer arms 106 are offset from the transverse support bar 100 and extend upwardly, terminating in opposed stub shafts 108. The stub shafts 108 are disposed to lie adjacent to the frame plate 110 of the back cushion assembly 102. A cushion 114 is attached to the frame plate 110 by means well known to the art.

A pair of opposed fingers 112A and 112B may be struck from the frame plate 110 to embrace the stub shafts 108 and permit the latter to rotate therebetween, at least through that number of degrees which affords comfortable engagement of the cushion 114 with a person sitting in the chair assembly 12. A decorative backing panel 116 may be secured to the frame plate 110 by snaps 117, and a pair of guard arms 118 extend outwardly from the decorative backing panel 116 to embrace the fingers 122 and thereby assist in maintaining the desired engagement between the fingers 112 and the stub shafts 108. The back cushion assembly 102 is thus capable of at least a limited degree of rotation about the transverse, rotational axis 120 of the pivot joint 104 in order to accommodate the back of the person seated in the chair assembly 12.

The base portion 86 of the stanchion 90 has a pair of lever arms 122A and 122B that are disposed laterally with respect to the sagittal plane 124 of the chair assembly 12. The outer end portion of each lever arm 122 terminates in a hook 126 that is adapted to receive a rod-like axle 128 upon which a low friction follower, or drive wheel, 130 is rotatably mounted. The follower 130 is preferably aligned with the sagittal plane 124 of the chair assembly 12, as seen in FIG. 6. The follower 130 preferably rests lightly against the interactive spring 60 when the chair assembly 12 is in the "at rest," or unoccupied, position depicted in FIG. 3.

As depicted in FIG. 6, the base portion 86 of the stanchion 90 also presents a curvilinearly contoured surface 132 which merges with an anchor surface 134. The first end 136 of a primary back spring 140 is attached to the anchor surface 134 in a manner similar to that used for the primary seat spring 40 as well as the interactive spring 60. That is, a mounting plate 42 overlies the first end 136 of the primary back spring 140, and a pair of fasteners 44 penetrate the mounting plate 42 and the first end 136 of the primary back spring 140 threadably to engage receiving bores 142 in the anchor surface 134. The second end 144 of the primary back spring 140 is disposed in sliding engagement with the undersurface 146 of the seat pan 72.

The primary seat springs 40, the interactive spring 60 and the primary back spring 140 are all preferably of the leaf spring variety. Although one may fabricate the aforesaid leaf springs from any desired material, it has been found that fiber reinforced plastic or carbon composite material works extremely well. As seen in FIG. 3, when the chair assembly 12 is empty—i.e.: in the "at rest" position—the primary seat springs 40 and the interactive spring 60 are laterally aligned. Particularly when the chair assembly 12 is empty, there is virtually no stress imparted to the primary seat springs 40 or the interactive spring 60. Similarly, the primary back spring 140 is also only slightly stressed under the virtually no load condition. As such, the primary seat springs 40 are only barely in contact with the curvilinearly contoured surfaces 36 on the spring support 30, and the primary back spring 140 is only barely in contact with the curvilinearly contoured surface 132.

When a person sits in the chair assembly 12, however, the primary seat springs 40 deflect under the weight of the person sitting on the seating portion 16. The weight of the person sitting in the chair will determine the extent to which the primary seat springs 40 will engage the curvilinearly contoured surfaces 36 on the spring support 30. The flexure characteristics of the primary seat springs 40 are directly affected by the extent to which the primary seat springs 40 engage the curvilinearly contoured surfaces 36. The greater the distance along the surfaces 36 that is contacted by the springs 40, the stiffer the springs 40 appear to be. Thus, if a relatively heavy person is seated in the chair, the weight of that person will establish flexure characteristics for the springs 40 which directly reflect the heavier weight of the person using the chair. In fact, the heavier the person is who is using the chair, the stiffer the chair will tend to be. Conversely, if a lighter person is using the chair, the chair will appear to have compensated on its own to provide a more flexible suspension mechanism 10. As such, a chair assembly 12 incorporating a suspension mechanism 10 embodying the concepts of the present invention is equally acceptable for use by virtually any size person.

Figure 7:
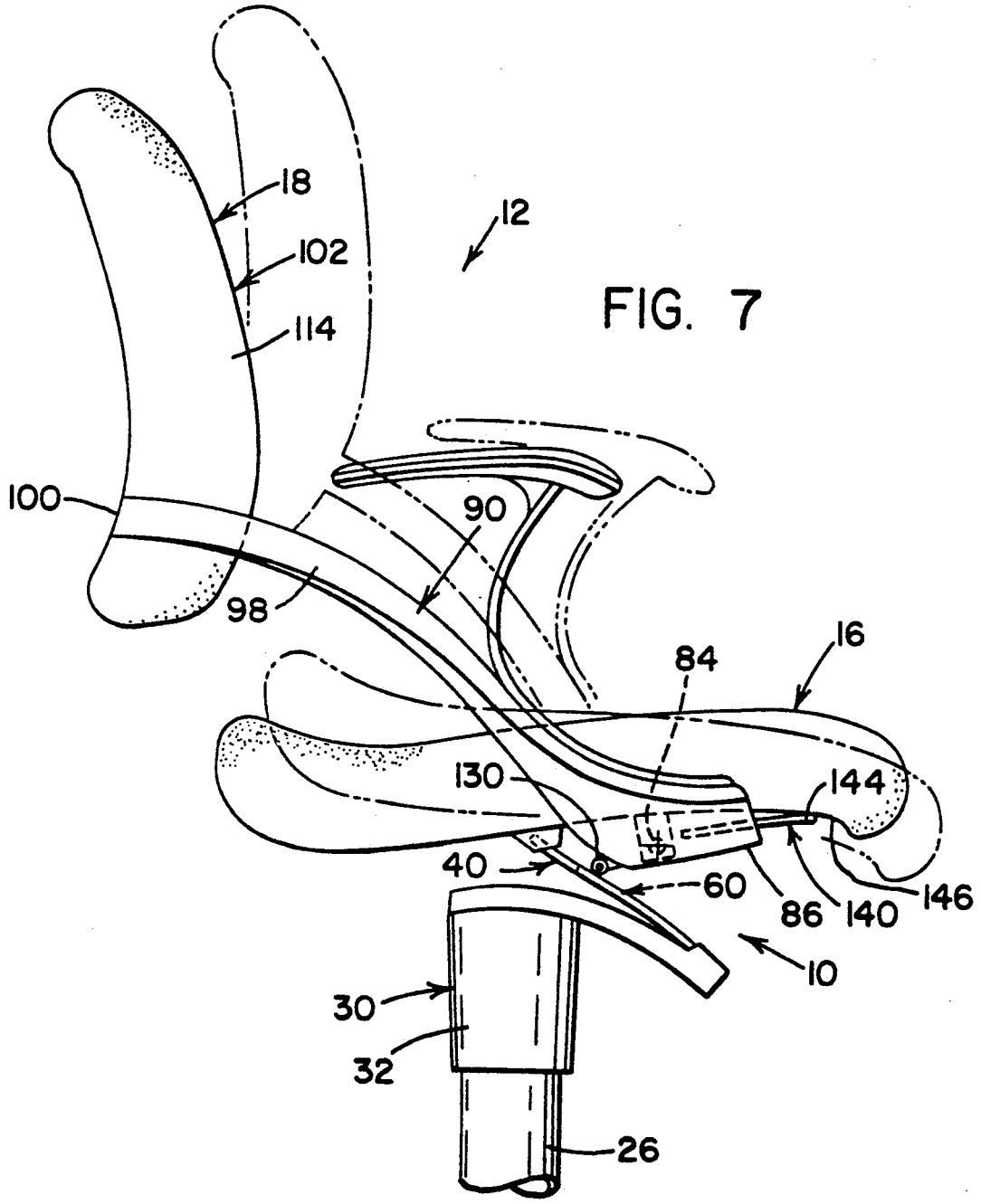
FIG. 7 is a schematic side elevation, similar to FIG. 3 but depicting the chair with both the seating portion having been tilted and the back supporting portion having been swung with respect to the pedestal assembly, the relative position of the back supporting portion with respect to the seating portion remaining substantially the same as that relationship is represented in FIG. 3.

Irrespective of the size of the person using the chair assembly 12, with the various springs having thus responded to the particular individual sitting in the chair, let it be supposed that the occupant of the chair 12 wishes to tilt the seating portion 16 rearwardly (while maintaining the existing angularity between the back supporting portion 18 and the seating portion 16). The occupant need merely shift his, or her, weight rearwardly on the seating portion 16. In response thereto the primary seat springs 40 will further deflect counterclockwise about the anchor surfaces 38, as seen in FIG. 7. As a result of this deflection, the primary seat springs 40 will come into increasing contact with the length of the curvilinearly contoured surfaces 36. Therefore, as the seat pan 72 is tilted, the resistance to further tilting will increase. Also during deflection of the primary springs 40 caused by moving the occupant's weight rearwardly on the seating portion 16, the interactive spring 60 will be deflected by the generally downward movement of the stanchion 90 as it is carried with the seating portion 16.

This downward movement of the stanchion 90 forces the follower 130 against the interactive spring 60. Engagement of the follower 130 with the interactive spring 60 flexes the interactive spring 60 and brings the interactive spring 60 into progressively increasing engagement with the curvilinear surface 54 on the movable wedge member 52. Because the wedge member 52 is movable, one can adjust the flexure characteristics of the interactive spring 60 by selectively positioning the wedge member 52 within the slideway 50 to control the amount of deflection required by the interactive spring 60 before it will engage the curvilinearly contoured surface 54 on the wedge member 52. This simple predisposition of the wedge member 52, by means more fully hereinafter described, offers a relatively easy way in which to adjust the stiffness of the chair 12 in response to the particular person who will use it.

Figure 8:
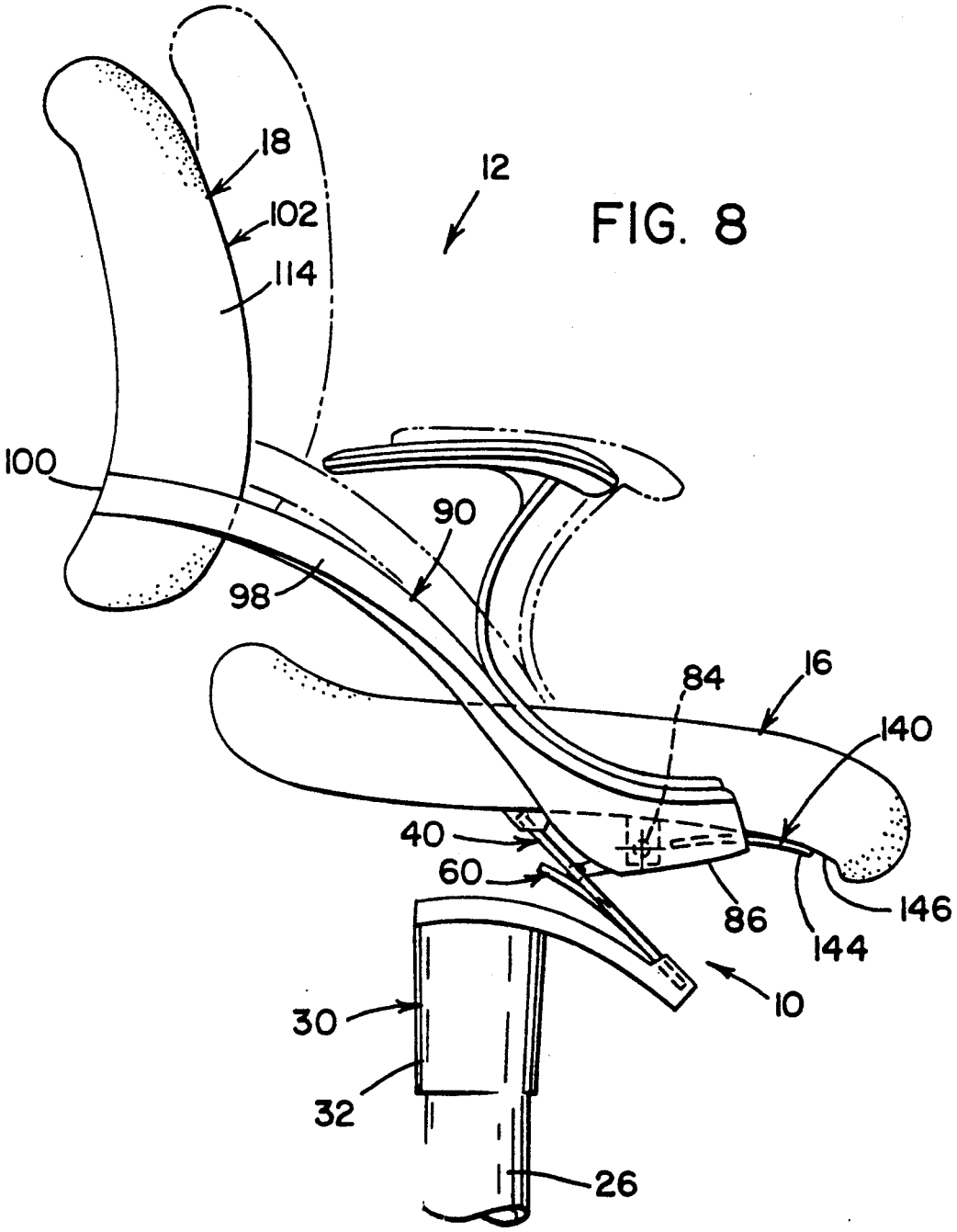
FIG. 8 is a schematic side elevation similar to FIGS. 3 and 7, but depicting the chair with only the back supporting portion having been tilted with respect to the seating portion, the seating portion remaining fixedly disposed relative to the pedestal assembly.

Returning to the disposition of the chair components when the occupant of the chair first sat down—and with the various springs having responded to the particular individual sitting in the chair 12—let us suppose that the occupant of the chair assembly 12 leans rearwardly into the back supporting portion 18 without tilting the seating portion 16. Such movement will swing the stanchion 90 about the journals 84, as seen in FIG. 8. When the back supporting portion 18 thus swings in response to movement of the person sitting in the chair 12, the second end 144 of the primary back spring 140 will not only slide along the undersurface 146 of the seat pan 72 but the action of the second end 144 of the primary back spring 140 against the undersurface 146 of the seat pan 72 will cause the primary back spring 140 to flex, thereby progressively engaging the curvilinearly contoured surface 132 and thus also progressively stiffening the flexure characteristics of the primary back spring 140 which imparts resistance to the rearward swinging movement of the back supporting portion 18. This rearward swinging movement of the back supporting portion 18 also forces the follower 130 to engage, and flex, the interactive spring 60. As such, the interactive spring 60 also supplies an additional biasing force which tends to resist the rearward swinging movement of the back supporting portion 18.

Figure 9:
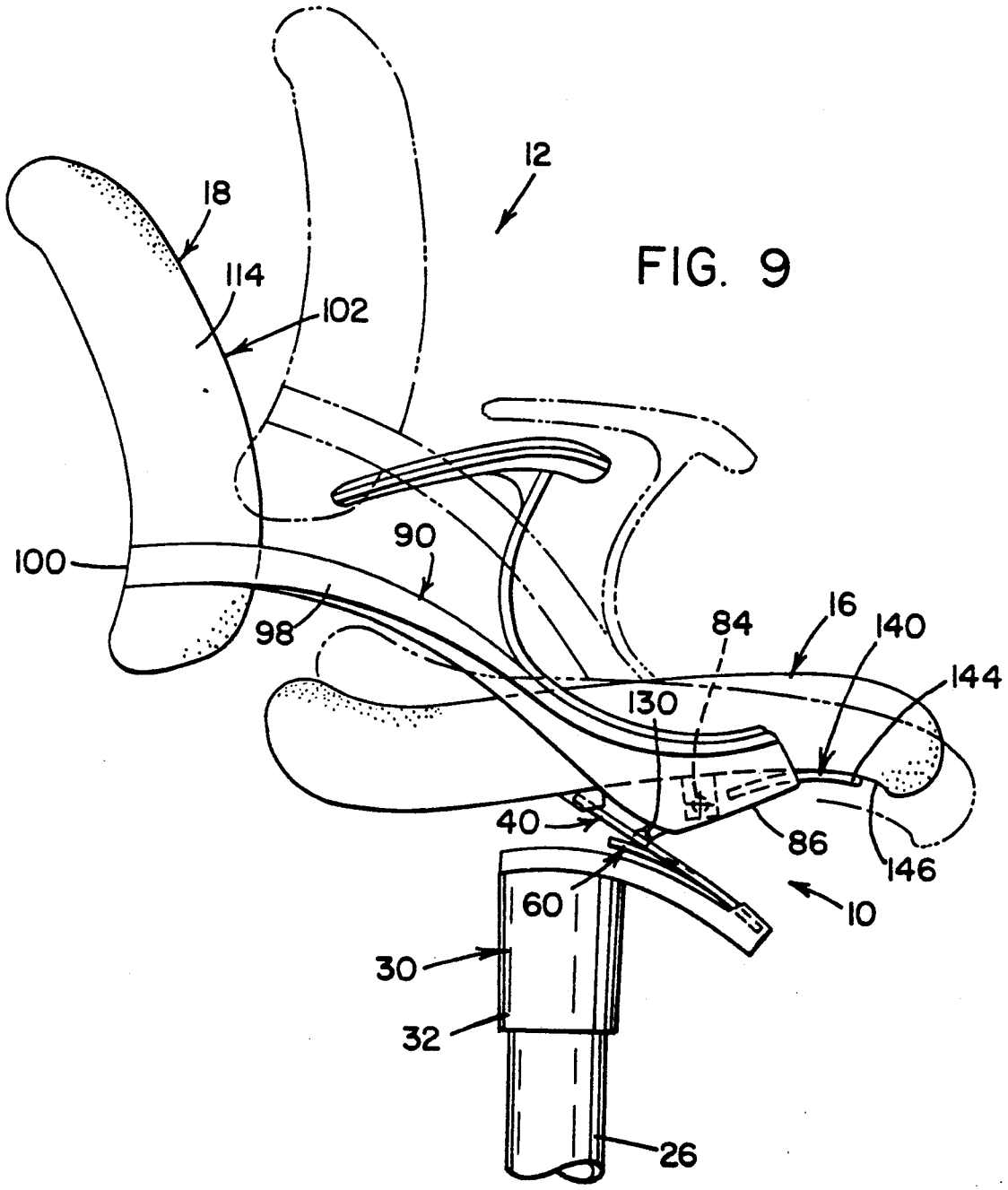
FIG. 9 is a schematic side elevation, more closely similar to FIG. 7, with both the seating portion having been tilted and the back supporting portion having been swung with respect to the pedestal assembly, but with the back supporting portion having been swung through a significantly greater angular displacement than the angular displacement through which the seating portion has been tilted.

It is, of course, also possible that the person occupying the chair 12 will desire not only to tilt the seating portion 16 rearwardly but simultaneously also to swing the back supporting portion 18 rearwardly, as seen in FIG. 9. In addition to the movement of the back supporting portion, as heretofore described, the tilting of the seating portion 16 will also cause the follower 130 to engage, and flex, the interactive spring 60 in the same manner heretofore described in conjunction with the explanation as to the action of the primary seat springs 40 and the interactive spring 60 when the seating portion 16 is tilted.

A chair embodying the concepts of the present invention may secure the chair so that only the seating portion 16 will tilt or so that only the back supporting portion 18 will swing, as desired. Such a response may be obtained by the use of a pair of lock-out assemblies 150, a representative example of which is depicted in FIGS. 6 and 12 through 14.

Figure 13:
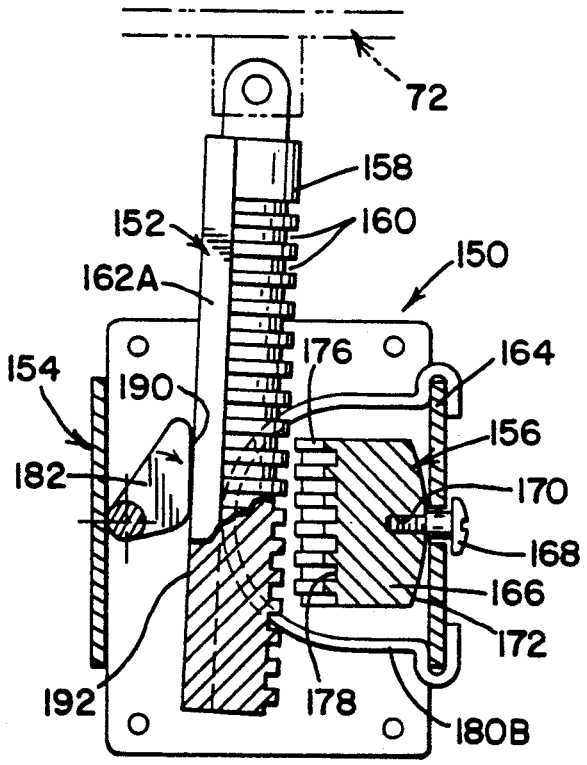
FIG. 13 is a vertical section taken substantially along line 13—13 of FIG. 12.
Figure 14:
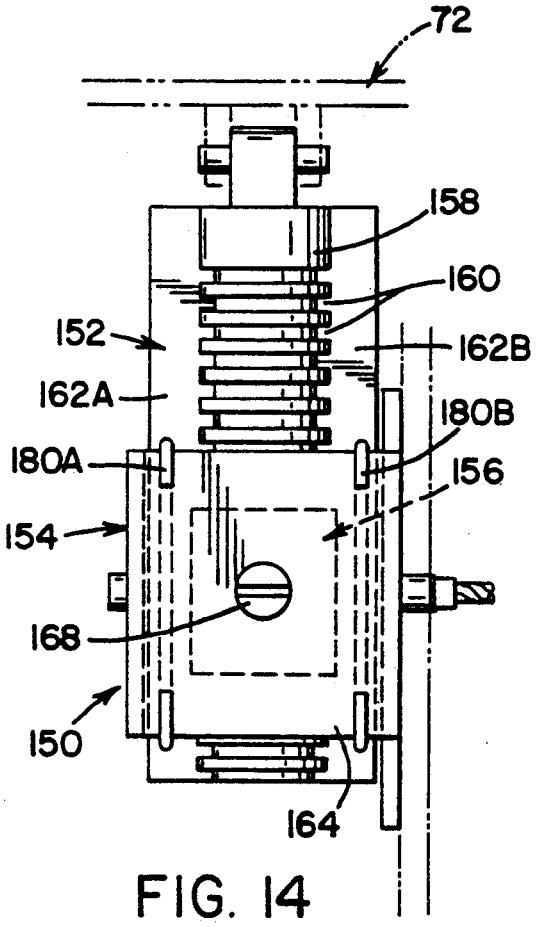
FIG. 14 is a side elevation of the housing depicted in FIGS. 12 and 13.

With particular reference, then, to FIG. 13, the lock-out assembly 150 utilizes a lock bar 152 which reciprocates within a housing 154 that contains the lock and release mechanism 156. The exemplary lock bar 152 depicted employs a semi-cylindrical shaft portion 158 which presents a plurality of teeth 160 that extend axially along the outer surface of the shaft portion 158. A pair of shoulders 162A and 162B extend radially outwardly on diametrically opposite sides of the shaft portion 158.

Figure 12:
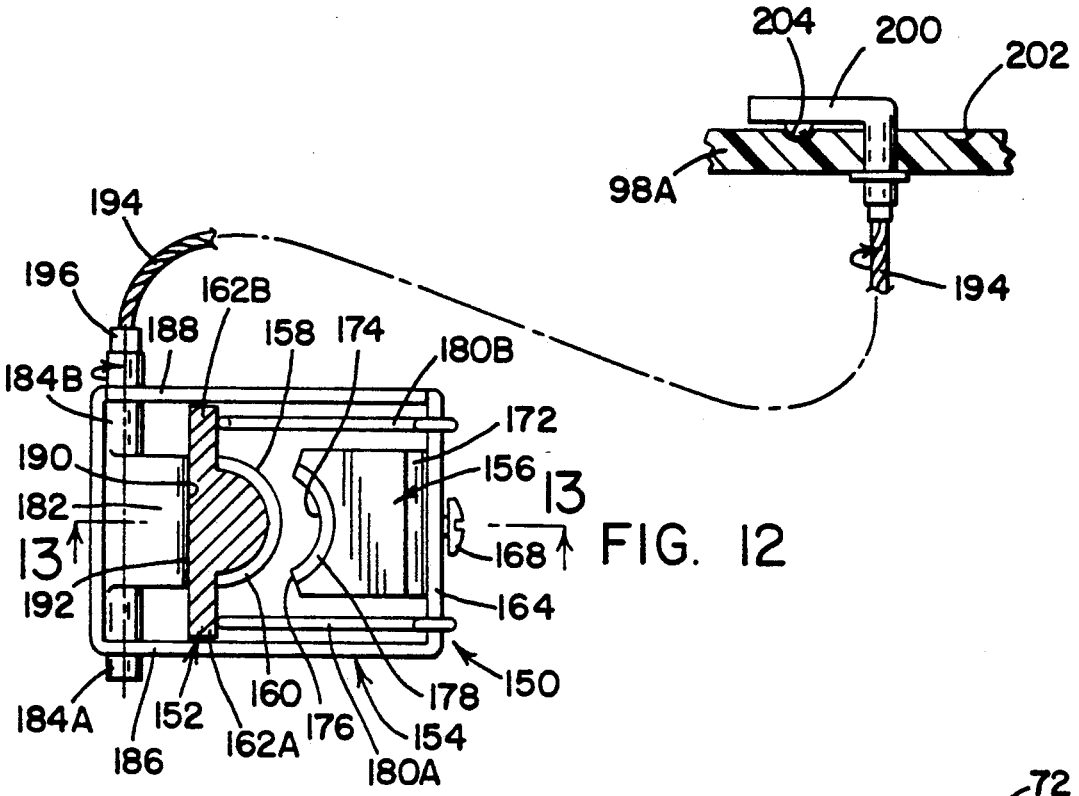
FIG. 12 is a schematic representation of a representative lock-out assembly, with the housing thereof being depicted in horizontal section.

The housing 154 of the lock-out assembly has a support plate 164 from which a locking block 166 is supported. Specifically, a mounting bolt 168 passes through the support plate 164 and is received within a bore 170 in the reverse face 172 of the locking block 166. The mounting bolt 168 is tightened sufficiently to secure the locking block 166 to the support plate 164 but is loose enough to permit the locking block 166 to adjust to the modest difference between the angularity of the lock bar 152 as it swings between the engaged and the disengaged positions. To understand the engaged and the disengaged positions it must be noted that the locking block 166 has a recess 174 in the obverse face 176 thereof. The semi-cylindrical inner surface of the recess 174 presents a plurality of teeth 178 which are adapted matingly to engage the teeth 160 on the shaft portion 158 of the lock bar 152. With this background it can be seen that the movement of the locking block 166 is necessary to accommodate full engagement of the teeth 178 in the semi-cylindrical recess 174 of the locking block 166 with the teeth 160 on the lock bar 152. Engagement, and disengagement, of the teeth 160 and 178 can be enhanced by making the reverse face 172 of the locking block 166 arcuate about an axis disposed transversely of the recess 174, as best seen in FIG. 12. Thus, the combination of the arcuate, reverse face 172 and the modestly loose engagement of the mounting bolt 168 permit the desired accommodation of the teeth 178 in the locking block 166 to the teeth 160 on the lock bar 152.

Spring means are employed to bias the teeth 160 on the lock bar 152 out of engagement with the teeth 178 on the locking block 166. As depicted in FIG. 12, a pair of release springs 180A and 180B may be secured to the support plate 164 and engage the opposed shoulders 162A and 162B, respectively, to bias the lock bar 152 away from the locking block 166.

An actuating throw arm 182 is pivotally mounted within the housing 154. Specifically, a pair of stub shafts 184A and 184B extend outwardly from the opposite sides of the actuating throw arm 182 to be journaled within the laterally spaced, side walls 186 and 188 of the housing 154. A cam surface 190 on the actuating throw arm 182 engages the spine surface 192 on the lock bar 152. As such, rotation of the actuating throw arm 182 (clockwise as seen in FIG. 13) drives the cam surface 190 against the spine surface 192 on the lock bar 152 to drive the teeth 160 on the lock bar 152 against the teeth 178 in the recess 174 of the locking block 166.

A cable 194 is secured to the transverse end surface 196 of the stub shaft 184B so that rotation of the cable 194 will effect rotation of the actuating throw arm 182. The opposite end of the cable 194 is secured to a control lever 200 which may be journaled for rotation in the support arm 98A of the stanchion. For convenience, the control lever 200 can be located in proximity to the juncture of the base portion 86 with the support arm 98A. At this point it should be noted that the control lever 200 may well be preferred to be presented from support arm 98A. The control lever 200, and/or the other controls hereinafter described, can be located on whatever side, or sides, of the chair assembly 12 one might prefer—their location does not affect their operation.

The control lever 200 engages first and second detents 202 and 204, respectively, which define the extent to which the control lever 200 can be rotated. When the control lever 200 has been rotated to engage the first detent 202 the rotational force applied to the control lever 200 is transferred through the cable 194 to rotate the actuating throw arm 182. In the situation where the teeth 160 and 178 mesh, the throw arm 182 will secure the lock bar 152 in the proper position with respect to the locking block 166. Engagement of the control lever 200 with the first detent 202 may well be sufficient to maintain the actuating throw arm 182 in the desired position, however, it is possible to configure the cam surface 190 so that it will assume an over-the-center locking engagement with the spine surface 192 on the lock bar 152.

On the other hand, if the teeth 160 and 178 do not mesh, the cable 194 is capable of storing the energy created by the rotational force applied to the control lever 200 until some relative movement between the lock bar 152 and the locking block 166 occurs which will effect a meshing alignment of the teeth 160 and 178. At that time the stored energy in the cable 194 will complete the rotation of the actuating throw arm 182 and effect the desired locking of the lock bar 152 against the locking block 166.

Conversely, when one wishes to release the lock-out assembly 150 the control lever 200 is rotated to release it from engagement with the first detent 202 and bring it into operative engagement with the second detent 204. Such rotation is transferred through the cable 194 the counter-rotate the actuating throw arm 182 and allow the release springs 180 to bias the lock bar 152 away from the locking block 166, thus disengaging the teeth 160 from the teeth 178.

The afore-described lock-out assembly 150 can be used not only to effect selective immobilization of the back supporting portion 18 in relation to the seating portion 16 but also to effect selective immobilization of the seating portion 16 with respect to the pedestal assembly 14, or, if desired, simultaneously to immobilize both movements. To effect immobilization of the back supporting portion 18 with respect to the seating portion 16 the lock bar 152 is secured to the seat pan 72, and the housing 154 is secured to, or incorporated in, the base portion 86 of the stanchion 90, as depicted by lock-out assembly 150A in FIG. 6. Similarly, to effect immobilization of the seating portion 16 with respect to the pedestal assembly 14 the lock bar 152 is also secured to the seat pan 72, but the housing 154 is secured to, or incorporated in, the spring support 30. This arrangement is represented by lock-out assembly 150B in FIG. 6 wherein the housing 154 is incorporated along the exterior surface of the cylindrical mounting cup 32.

Figure 15:
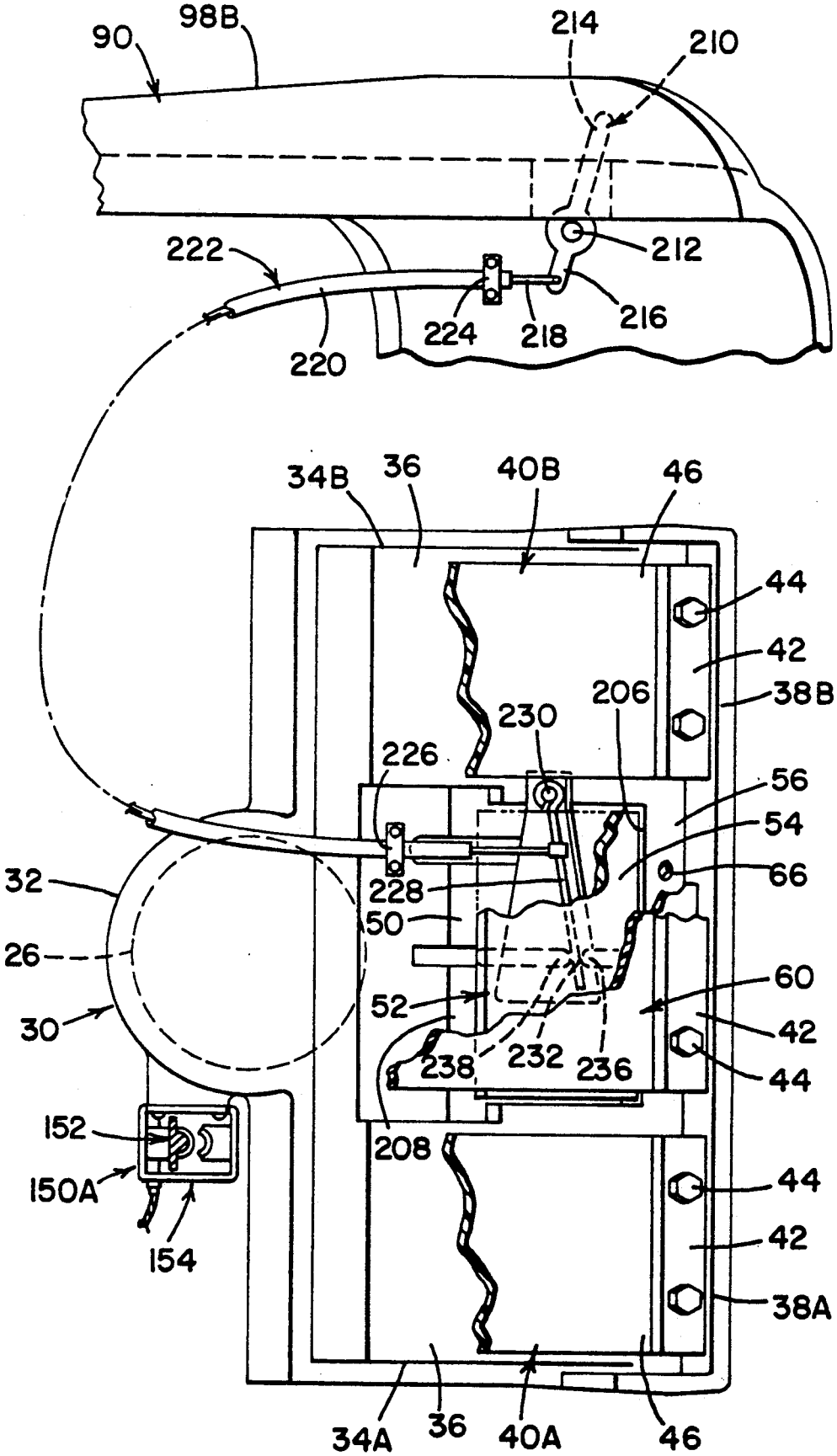
FIG. 15 is a schematic representation of a structural arrangement by which to effect translation of the movable wedge member associated with the interactive spring, the spring support being shown in top plan to reveal the incorporation of the lock-out assembly as it is secured to the spring support, the spring support also being partly broken away more precisely to reveal the mechanism by which the control lever effects translation of the wedge member.

As previously mentioned, the wedge member 52 is movable within the slideway 50 in order to adjust the flexure characteristics of the interactive spring 60. With particular reference to FIG. 15, the movable wedge member 52 is depicted at end 206 of the slideway 50. In this position the interactive spring 60 has the lightest pre-load and the lowest spring rate. Thus, when the wedge member 52 is located in proximity to end 206 of the slideway 50, the interactive spring 60 provides the least resistance to movement of the seating portion 16 or the back supporting portion 18. As the wedge member 52 is moved toward the end 208—the opposite end of the slideway 50—the spring rate of the interactive spring 60 will increase. Therefore, if increased resistance is desired for a given angular range of movement for the back supporting portion 18, the wedge member 52 is moved toward end 208 of the slideway 50.

It should also be recalled that the flexure characteristics of the interactive spring 60 contibute to the basic stiffness of the chair assembly 12 inasmuch as the follower 130 applies some pressure to the interactive spring 60 when a relatively heavy person sits on, or attempts to tilt, the seating portion 16 or swing the back supporting portion 18.

The movement of the wedge member 52 required to achieve the desired flexure characteristics of the interactive spring 60 can also be effected by manual operation of a control lever 210 that may, for convenience, be located in support arm 98B of the stanchion 90, as shown, or, if desired, the control lever 210 may be located in proximity to the control levers 200. As depicted in FIG. 15, the control lever 210 is mounted on a pivot pin 212 with the effort arm 214 extending outwardly from the pivot pin 212 to be available for manipulation by the person who is adjusting the chair assembly 12. The diametrically opposed resistance arm 216 extends inwardly from the pivot pin 212, and thus inwardly relative to the support arm 98B of the stanchion 90. The end of the resistance arm 216 is secured, by means well known to the art, to a core 218 that is slidably received within the sheath 220 of a push pull control cable 222.

That end of the sheath 220 adjacent the resistance arm 216 is secured to the stanchion 90, as by a first mounting bracket 224. The opposite end of the sheath 220 is secured to the spring support 30, as by a second mounting bracket 226. Outwardly of the second mounting bracket 226 the core 218 exits the sheath 220 and is attached to a spring arm 228. The spring arm 228 is mounted on a pivot 230 presented from the spring support 30 and extends from the pivot 230 to be swingingly received in a recess 232 incised in the undersurface 234 of the wedge member 52—the curvilinearly contoured surface 54 being presented from the opposite side of the wedge member 52.

Thus, should the person adjusting the chair 12 wish to translate the wedge member 52 toward the first end 206 of the slideway 50, as would be required to increase the stiffness of the interactive spring 60, he, or she, would pivot the control lever 210 clockwise, as viewed in FIG. 15, to push the core 218, which results in counterclockwise movement of the spring arm 228, thus driving the spring arm 228 against wall 236 of the recess 232 and thus urging the wedge member 52 toward the first end 206 of the slideway 50.

It should be appreciated that if the chair 12 is occupied, the weight on the seating portion 16 could be sufficient for the follower 130 to have forced the interactive spring 60 against the curvilinearly contoured surface 54 on the wedge member 52, thus precluding translation of the wedge member 52. By making the spring arm 228 from a material that will flex, the operator will immediately notice that the control lever 210 will not remain in the position selected, but will, instead, simply return to the position it had been in when the adjustment was begun. As such, a tactile signal is provided by the structural configuration described. The unspoken message is that the wedge member 52 cannot be moved until the interactive spring 60 is unloaded. It is also possible to provide a detent means (not shown) that would retain the control lever 210 in the position to which it had been moved, thereby allowing the spring arm 228 to store the energy necessary to translate the wedge member 52 until such time as the load on the chair assembly 12 is reduced to the point where the spring arm 228 can effect the desired, preselected, translation of the wedge member 52.

Once the interactive spring 60 disengages from the curvilinearly contoured surface 54 on the wedge member 52 the latter can be easily translated along the slideway 50 to the desired location.

Conversely, should one wish to decrease the stiffness of the interactive spring 60, the control lever 210 is rotated in the opposite direction (counterclockwise as viewed in FIG. 15) to pull the core 218. Thus, pulling on the core 218 effects clockwise movement of the spring arm 228 against the wall 238 of the recess 232, and thereby urges the wedge member 52 toward the second end 208 of the slideway 50. This location of the wedge member 52 delays engagement of the interactive spring 60 with the curvilinearly contoured surface 54 on the wedge member 52 to decrease the stiffness of the interactive spring 60. Here, too, the control lever 210 will provide a tactile signal if the wedge member 52 is locked such that it cannot be translated within the slideway 50.

To summarize the several advantages of the present invention which are provided by the exemplary embodiment heretofore described, it must be appreciated that the primary seat springs 40, which connect the seating portion 16 to the spring support 30, serve the purpose of supporting the seating portion 16. The primary seat springs 40 also allow the seating portion 16 to tilt rearwardly, to provide that desired feature of many conventional chairs. The primary seat springs 40 further allow the seating portion 16 to tilt forwardly, a feature provided by the newer style "task chairs". The "at rest" position between these ranges of movement is most appropriate for entry and egress. It should also be noted that no pivot axles are required to support the seating portion 16, thus reducing friction and the potential for wear and squeaking.

The interactive spring 60, which is preferably mounted from the spring support 30, provides additional biasing force when the seating portion 16 is tilted rearwardly. The interactive spring 60 also supplies additional biasing force when the back supporting portion 18 is swung rearwardly, as previously discussed. When the seating portion 16 is tilted, and the back supporting portion 18 is swung with respect to the seating portion 16, the biasing effect is compounded. This compounding is desirable because the load on the back supporting portion 18 increases as the seating portion 16 is tilted rearwardly. The rearward tilt if the seating portion 16 allows the torso of the person in the chair 12 to move further rearwardly with respect to the center line of the pedestal assembly 14. By the same token, swinging the back supporting portion 18 in relation to the seating portion 16 similarly moves the torso of the occupant further rearwardly from the center line of the pedestal assembly 14, putting an additional load on the primary seat springs 40. The interactive spring 60 compensates for these changes, providing a comfortable, balanced feeling regardless of the relative positions of the seating and back supporting portions. Previous chair constructions in which the back supporting portion swung as the seating portion tilted have been restricted to a synchronized movement so that loading would be predictable and would be capable of being accommodated by chairs which do not incorporate the concepts of the present invention.

It should also be emphasized that the use of curvilinearly contoured surfaces provides the desired change in the flexure characteristics of the springs when a heavy person sits in the chair. As the springs deflect downwardly the curvilinearly contoured surfaces are designed progressively to shorten the effective length of the springs. On the other hand, a light person does not deflect the springs sufficiently to effect engagement between the springs and the curvilinearly contoured surfaces. Accordingly, people of any size can use the chair with absolute comfort.

Some individuals prefer a softer, or a firmer, spring action in a chair. The necessary adjustment to the flexure characteristics of the chair can be accomplished by the use of a movable wedge member 52 to coact with the interactive spring 60. The interactive spring 60 also incorporates a curvilinearly contoured surface 54, and by being movable a person can change the location of the wedge member 52 within the slideway 50 with comparative ease when the chair is "at rest" and with no one sitting therein. This ease of adjustment contrasts with most chair mechanisms in which the main support spring must be compressed or relieved by taking many turns on an adjusting knob.

Independent movement of the seating portion 16 and the back supporting portion 18 allows the occupant to assume whatever position is most comfortable for the task at hand. Most chairs have a fixed seat-to-back angle. If the occupant prefers a more open angle, his, or her, only recourse is to sit on the front edge of the seat and lean against the top edge of the back. Those chairs which do allow the back to move in relation to the seat generally have a fixed seat. A few expensive products on the market provide back movement in relation to a moving seat but that movement follows a standard pattern. For example, two degrees of swing for the back supporting portion for each one degree of tilt for the seating portion. The independent movement of the seating portion 16 and the back supporting portion 18 provided by the present invention allows the chair to respond to the desired angularity between the seating portion 16 and the back supporting portion 18 for each individual occupant, and for each task to be performed by the person using the chair 12.

By hinging the back supporting portion 18 at a point beneath, and toward the front of, the seating portion 16, scrubbing is eliminated—an adverse feature common to the vast majority of chairs in which the back supporting portion moves in relation to the seating portion.

Inclusion of a horizontal pivot joint in the back cushion assembly 102 allows the cushion assembly 102 to maintain full contact with the occupant of the chair 12, and thus fully supports the back of the occupant during minor changes of posture. This arrangement also accommodates various seating postures. For example, two people may prefer to have the back in the same place in relation to the seat but one person may sit quite upright while another may sit forward or lean back.

Movement of the back supporting portion 18 in relation to the seating portion 16, or the seating portion 16 in relation to the pedestal assembly 14, can be immobilized by use of easily manipulated, conveniently located control levers 200. Use of the lock-out mechanisms 150 operated by the levers 200 allows the occupant to immobilize the chair, or selected components thereof, in whatever position the occupant desires. Selective use of the lock-out mechanisms 150 allow the chair to provide the action of virtually every other type of prior known office chair, but without the limitations inherent to each of the prior known arrangements. This allows a facility manager to purchase one chair for all, knowing it will be appropriate for whatever tasks are to be performed, rather than purchasing separate chair types for each different type of job.

A FIRST ALTERNATIVE EMBODIMENT

Figure 16:
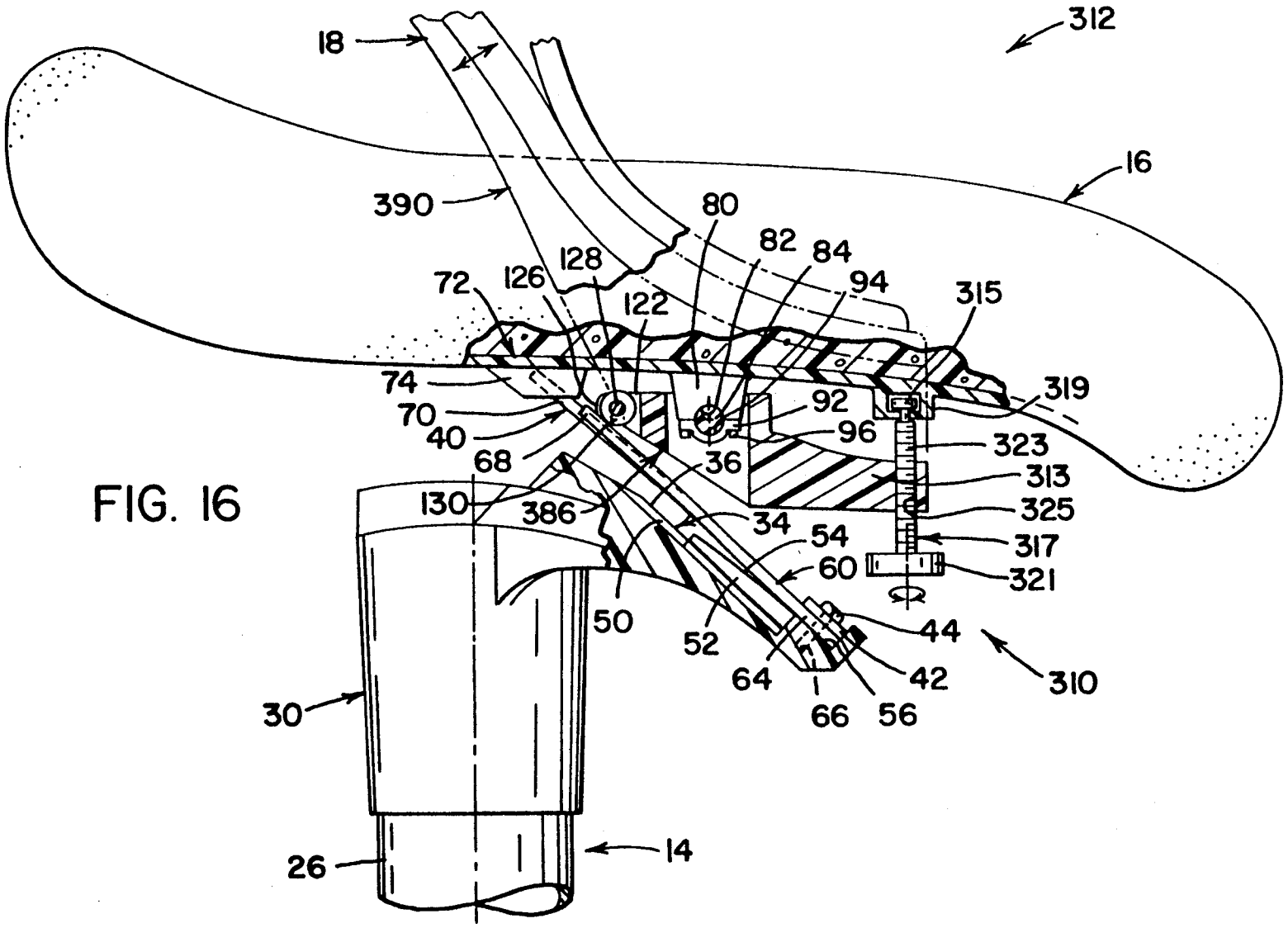
FIG. 16 is a schematic side elevation, partly broken away to depict the inter-engagement of the suspension system relative to the pedestal assembly, the seating portion and the back supporting portion in an alternative embodiment wherein the disposition of the back supporting portion may be manually adjusted with respect to the seating portion but wherein those two components remain fixed with respect to each other irrespective of the weight distribution, or movement, of an occupant in the chair.

With reference now to FIG. 16, one alternative embodiment of a suspension mechanism embodying the concepts of the present invention is identified generally by the numeral 310 and is incorporated in a chair assembly 312.

For convenience, those components utilized in the chair assembly 312 which may be identical to those components utilized in chair assembly 12 will be designated by the same numerical identifiers utilized in that particular assembly, and those components of chair assembly 312 which are different than, or which constitute distinct structural variations of, the corresponding, or similar, structural members in chair assembly 12 will be identified by a three digit numerical identifier which begins with the numeral "3". As such, the suspension 310, is employed manually to adjust the disposition of the back supporting portion 18 with respect to the seating portion 16. Such an arrangement prevents the back supporting portion 18 from moving with respect to the seating portion 16 in response to movement of the person occupying the chair assembly 312.

The pedestal assembly 14 of the suspension mechanism 310 also includes a cylindrical post 26 on the top of which a spring support 30 may be secured. The spring support 30 has a pair of laterally spaced, spring engaging ramps 34, as more particularly described in conjunction with FIG. 3. In the same manner as shown in FIG. 15, the upwardly facing surface 36 within each spring engaging ramp 34 is curvilinearly contoured, and each curvilinearly contoured surface 36 merges into an anchor surface 38.

The chair assembly 312 continues to be similar to chair assembly 12 in that, as depicted in FIG. 16, a primary seat spring 40 is secured to each of the laterally spaced anchor surfaces 38. To effect attachment of each primary seat spring 40 to its respective anchor surface 38 on the spring support 30, individual mounting plates 42 and threaded fasteners 44 may be employed. A mounting plate 42 is disposed to overlie the first end portion 46 of each primary seat spring 40 so the fasteners 44 may pass through appropriate openings in each mounting plate 42 as well as through openings in the first end portion 46 of each primary seat spring 40 and finally into receiving bores 48 in the laterally spaced anchor surfaces 38. The primary seat springs 40 are, therefore, securely anchored to the spring support 30, and thereby to the pedestal assembly 14.

Referring once again to FIG. 16, a central slideway, or recess, 50 houses a movable wedge member 52 which may be selectively positionable along the slideway 50 to adjust the flexure characteristics of the interactive spring 60, as also described in conjunction with FIG. 15. The upwardly facing surface 54 on the movable wedge member 52 is also curvilinearly contoured and may be juxtaposed to a centrally located spring anchor surface 56 which is also presented from the spring support 30.

An interactive spring 60 is centrally positioned on the spring support 30 intermediately with respect to the primary seat springs 40. The interactive spring 60 is attached to the spring support 30 in a manner similar to that used for the attachment on the primary seat springs 40. That is, a mounting plate 42 is disposed to overlie the first end portion 64 of the interactive spring 60, and a pair of threaded fasteners 44 are inserted through appropriate openings provided in the mounting plate 42, through registered bores in the first end portion 64 of the interactive spring 60 and into one or more receiving bores 66 in the central anchor surface 56.

As described in conjunction with chair assembly 12, when properly secured to the anchor surfaces 38, each of the primary seat springs 40 are vertically aligned with one of the curvilinearly contoured surfaces 36 on the ramps 34. So aligned, the primary seat springs 40 extend generally rearwardly and upwardly from the respective, laterally spaced anchor surfaces 38. The interactive spring 60, which is located between the laterally spaced primary seat springs 40, is vertically aligned with the central slideway 50 on the spring support 30. The interactive spring 60 extends generally rearwardly and upwardly from the central anchor surface 56. As such, the interactive spring 60 is cantilevered outwardly from the central anchor surface 56 to which the first end portion 64 of the interactive spring 60 is secured. The second end portion 68 of the interactive spring 60 is, therefore, unsupported.

The second end portion 70 of each primary seat spring 40 is connected to the seat pan 72 in the seating portion 16 of the chair assembly 312 at anchor surfaces 74 in the same manner shown and described in conjunction with FIG. 5.

The seat pan 72 in chair assembly 312 (FIG. 16) also has a pair of mounting blocks 80 each having a bearing surface in the configuration of a semi-cylindrical saddle 82. The seat pan 72 is mounted on a pair of laterally spaced, cylindrical journals 84 formed integrally with the base portion 386 of a stanchion 390. A cap 92 having an opposed, semi-cylindrical, bearing surface 94 is secured to each mounting block 80 with one of the journals 84 disposed between the opposed bearing surfaces 82 and 94. A pair of fasteners 96 may be employed to secure each cap 92 to its respective mounting block 80. The journals 84 thus define the pivotal axis about which the stanchion 390 may be adjustably swung with respect to the seating portion 16.

At this point it should be appreciated that the primary distinction between chair assembly 12 and chair assembly 312 is that the stanchion 390 does not freely swing with respect to the seating portion 16 in response to the weight and movement of the person occupying the chair assembly 312. To that end, a rigid lever arm 313 projects forwardly from the base portion 386 of the stanchion 390. One end 315 of an adjusting shaft 317 is rotatably received within a cage 319 presented from the underside of the seat pan 72, and a knob 321 is fixedly presented from the opposite end portion of the shaft 317. The medial portion of the shaft 317 is threaded, as at 323, threadably to engage a bore 325 which penetrates the lever arm 313. As such, rotation of the shaft 317 by manual rotation of the knob 321 will cause the stanchion 390, and therefore the back supporting portion 18 to be adjustably positioned relative to the seating portion 16.

A pair of lever arms 122 also extend rearwardly from the base portion 386 of the stanchion 390. The lever arms 122 are preferably disposed laterally with respect to the sagittal plane of the chair assembly 312, and the outer end portion of each lever arm 122 terminates in a hook 126 that is adapted to receive a rod-like axle 128 upon which a low friction follower, or drive wheel, 130 is rotatably mounted. The follower 130 is preferably aligned with the sagittal plane of the chair assembly 312, and as such the follower 130 preferably rests lightly against the interactive spring 60 when the chair assembly 312 is in the "at rest," or unoccupied, position.

In the embodiment comprising the chair assembly 312 the action of the follower 130 effects only modest interaction with the interactive spring 60 upon pivotal adjustment of the back supporting portion 18. However, the interactive spring 60 is fully operative by engagement of the follower 130 with the interactive spring 60 upon tilting of the seating portion 16 with respect to the pedestal assembly 14.

A SECOND ALTERNATIVE EMBODIMENT

Figure 17:
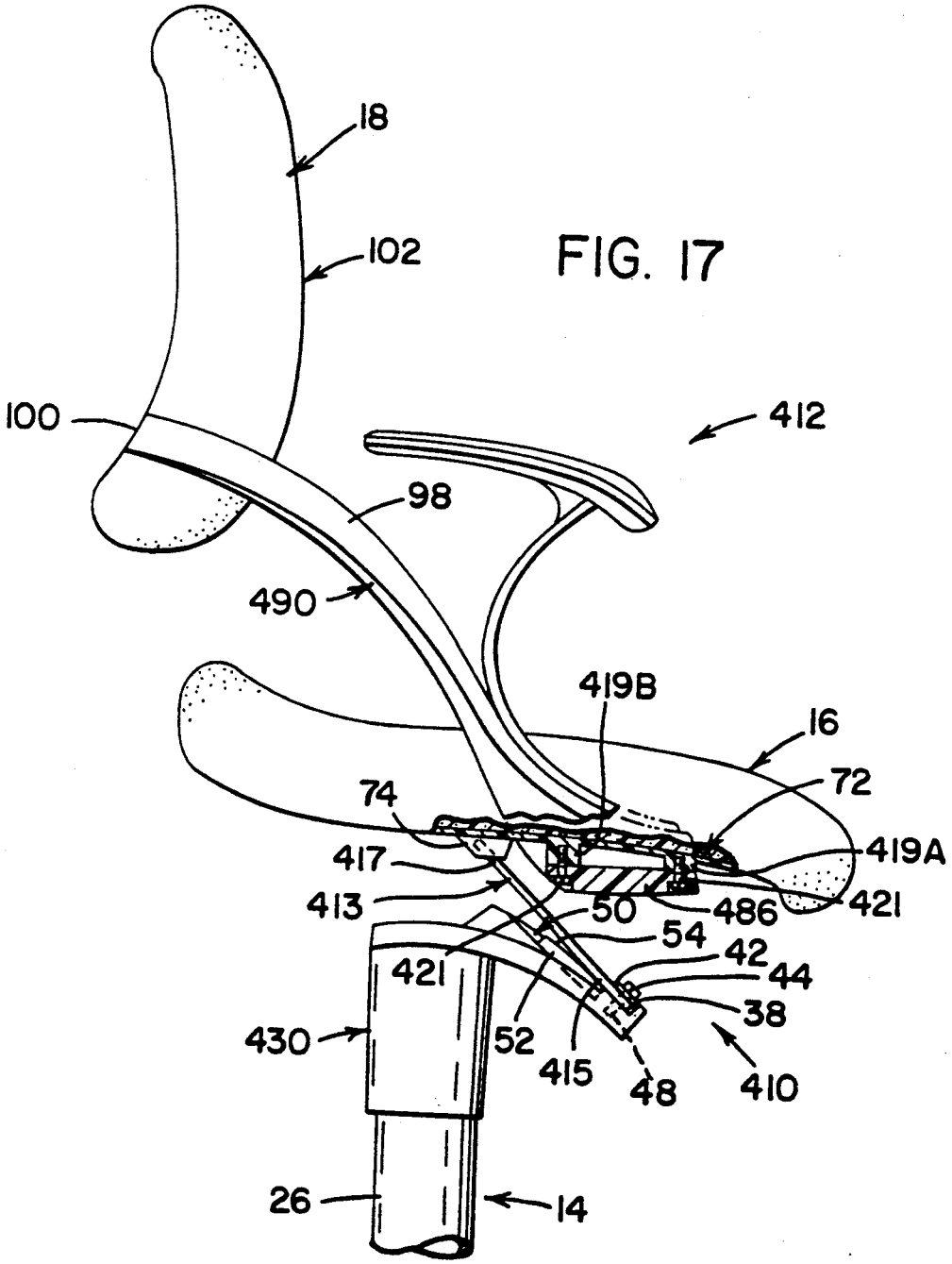
FIG. 17 is a schematic side elevation of a further alternative embodiment wherein the back supporting portion is permanently affixed to the seating portion and wherein the seating portion is supported from the pedestal assembly by virtue of an enhanced primary seat spring, and without the use of an interactive spring.

With reference now to FIG. 17, a second alternative embodiment of a suspension mechanism embodying the concepts of the present invention is identified generally by the numeral 410 and is incorporated in a chair assembly 412.

For convenience, those components utilized in the chair assembly 412 which may be identical to those components utilized in chair assemblies 12 and 312 will be designated by the same numerical identifiers utilized in those particular assemblies, and those components of chair assembly 412 which are different than, or which constitute distinct structural variations of, the corresponding, or similar, structural members in chair assemblies 12 and 312 will be identified by a three digit numerical identifier which begins with the numeral "4". As such, the suspension 410, is employed to permit only movement of the seating portion 16 with respect to the pedestal portion 14 in response to movement of the person occupying the chair assembly 412. In this embodiment the back supporting portion 18 remains fixedly secured to the seating portion 16, and as a result, the disposition of the back supporting portion 18 and can neither be adjusted manually with respect to the seating portion 16 nor will the back supporting portion 18 move with respect to the seating portion 16 in response to movement of the person occupying the chair assembly 412.

As in the previously described embodiments, the pedestal assembly 14 of the suspension mechanism 410 also includes a cylindrical post 26 on which a spring support 430 may be secured. In this embodiment, however, the central slideway, or recess, 50 provided in the spring support 430 preferably extends across substantially the full lateral extent of the spring support 430 to house a movable, selectively positionable, wedge member 52. The upwardly facing surface 54 on the movable wedge member 52 is curvilinearly contoured and may be juxtaposed to a spring anchor surface 38 which is also presented from the spring support 430.

A primary seat spring 413 is secured to the anchor surface 38. To effect attachment of the primary seat spring 413 to the anchor surface 38 on the spring support 430, a mounting plate 42 and threaded fasteners 44 may be employed. The mounting plate 42 is disposed to overlie the first end portion 415 of the primary seat spring 413 so the fasteners 44 may pass through appropriate openings in the mounting plate 42 as well as through openings in the first end portion 415 of the primary seat spring 413 and finally into receiving bores 48 in the anchor surface 38. The primary seat spring 413 is, therefore, securely anchored to the spring support 430, and thereby to the pedestal assembly 14.

When the primary seat spring 413 is properly secured to the anchor surface 38, the primary seat spring 413 extends generally rearwardly and upwardly from the anchor surface 38 to overlie the curvilinear, upwardly directed surface 54 on the wedge member 52.

The second end portion 417 of the primary seat spring 413 is connected to the seat pan 72 in the seating portion 16 of the chair assembly 412 at anchor surface 74 in a manner similar to that shown and described in conjunction with FIG. 5, except in the chair assembly 412 only a single, laterally extending primary seat spring 413 need be employed rather than the laterally spaced pair thereof, as employed in the previously described chair assemblies 12 and 312.

The back supporting portion 18 employed in chair assembly 412 also incorporates a stanchion 490 which has a pair of S-curved support arms 98 which are laterally spaced to lie on either side of the seating portion 16 and which extend between a base portion 486 to a transverse support bar 100 from which the back cushion assembly 102 may be presented. As distinct from the prior chair assemblies 12 and 312, in chair assembly 412 the base portion 486 is rigidly, and fixedly, secured to appropriate bosses 419A and 419B presented from the underside of the seat pan 72, as by cap screws 421.

At this point it may be repeated that the primary distinction between chair assembly 412 and chair assemblies 12 and 312 is that the stanchion 490 cannot swing with respect to the seating portion 16 in response to the weight and movement of the person occupying the chair assembly 412, nor can the disposition of the stanchion 490 be adjusted with respect to the seating portion 16. Nor, therefore, does chair assembly 412 utilize an interactive spring 60 and follower 130. Instead, the enhanced primary seat spring 413 co-operatively interacts with the curvilinear surface 54 on the movable wedge member 52 to achieve the desired flexure characteristics for the primary seat spring 413. The wedge member 52 may, if desired, be selectively positioned by the same lever and arm arrangement depicted and described in conjunction with FIG. 15.

A THIRD ALTERNATIVE EMBODIMENT

Figure 18:
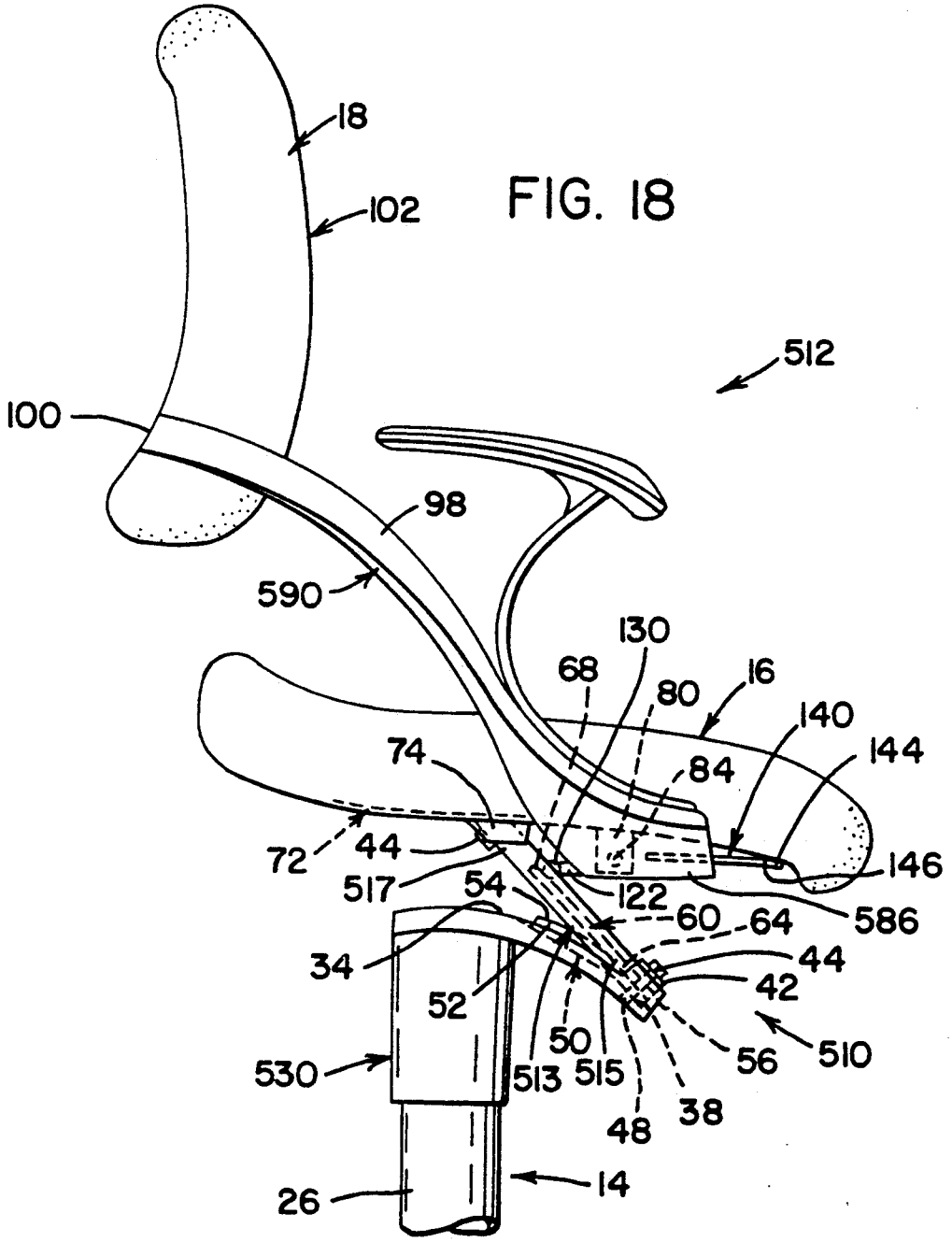
FIG. 18 is a schematic side elevation of a further alternative embodiment wherein the seating portion is immovably secured to the pedestal assembly but wherein the back supporting portion is supported from the seating portion in the same manner as depicted in the primary embodiment.

With reference now to FIG. 18, a third alternative embodiment of a suspension mechanism embodying the concepts of the present invention is identified generally by the numeral 510 and is incorporated in a chair assembly 512.

For convenience those components utilized in the chair assembly 512 which may be identical to those components utilized in chair assemblies 12, 312 and 412 will be designated by the same numerical identifiers utilized in those particular assemblies, and those components of chair assembly 512 which are different than, or which consitute distinct structural variations of, the corresponding, or similar, structural members in chair assemblies 12, 312 and 412 will be identified by a three digit numerical identifier which begins with the numeral "5". As such, the suspension mechanism 510 is employed to permit only movement of the back supporting portion 18 with respect to the seating portion 16 in response to movement of the person occupying the chair assembly 512. In this embodiment the seating portion 16 remains fixedly secured to the pedestal assembly 14.

As in the previously described embodiments, the pedestal assembly 14 of the suspension mechanism 510 also includes a cylindrical post 26 on the top of which a spring support 530 may be secured. In this embodiment, however, the spring support 530 is more like the chair assemblies 12 and 312, rather than chair assembly 412, in that the spring support 530 has a pair of laterally spaced ramps 34. The upwardly facing surface 36 of each ramp 34 of each 34 merges into an anchor surface 38.

One laterally spaced, substantially rigid connecting plate 513 may be secured to each of the laterally spaced anchor surfaces 38. To effect attachment of each connecting plate 513A and 513B to its respective anchor surface 38 on the spring support 530, individual mounting plates 42 and threaded fasteners 44 may be employed. It should be appreciated, however, that because of the rigid nature of the connecting plates 513 the threaded fasteners may not require the utilization of a mounting plate 42 to distribute the load along the end portion 515 of each connecting plate 513. Should one elect to employ mounting plates 42, each may be disposed to overlie the first end portion 515 of one connecting plate 513 so the fasteners 44 may pass through appropriate openings in each mounting plate 42 as well as through openings in the first end portion 515 of each connecting plate 513 and finally into receiving bores 48 in the laterally spaced anchor surfaces 38.

Figure 20:
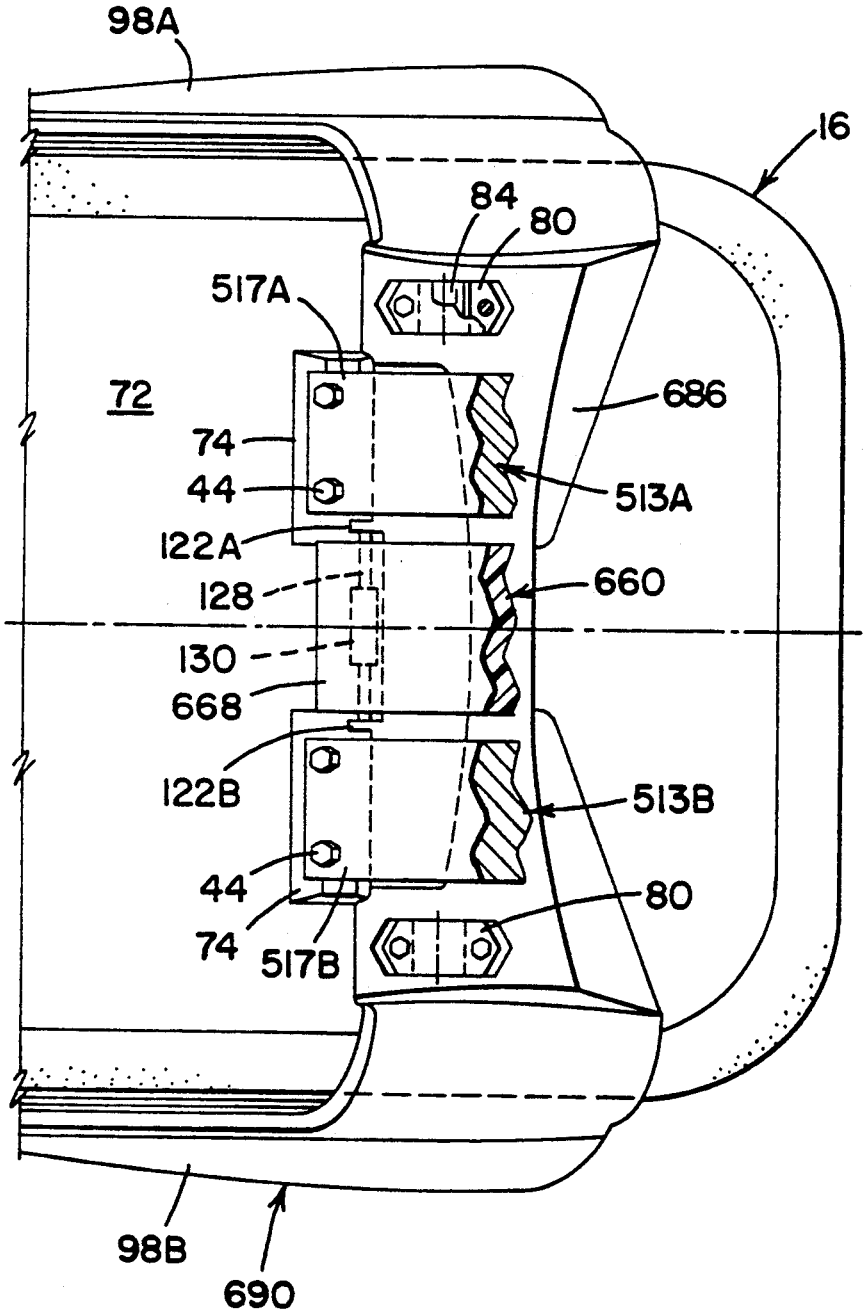
FIG. 20 is an enlarged section taken substantially along line 20—20 in FIG. 19 and depicting the seating portion of this fourth alternative embodiment in bottom plan.

When properly secured to the anchor surfaces 38, each of the connecting plates 513 extends generally rearwardly and upwardly from the respective, laterally spaced anchor surfaces 38. The second end portion 517 of each connecting plate 513 is connected to the seat pan 72 in the seating portion 16 of the chair assembly 512 at the anchor surfaces 74 in a manner similar to that shown and described in conjunction with FIG. 5. On the other hand, because of the rigidity of the connecting plates 513, they may, as depicted in FIG. 20, be secured to the anchor surfaces 74 merely by means of threaded fastener means 44 in the nature of cap screws which penetrate the end portions 517 of the rigid connecting plates 513 to be received within appropriately threaded bores, not shown, in the anchor surfaces 74. As such, the seating portion 16 is securely anchored to the pedestal assembly 14 such that any relative movement between the seating portion 16 and the pedestal assembly 14 is precluded.

Similarly to the arrangement depicted in FIG. 6, a central slideway, or recess, 50 is provided between the anchor surface 38 on the spring support 530 to house a movable, selectively positionable, wedge member 52. The upwardly facing surface 54 on the movable wedge member 52 is curvilinearly contoured and may be juxtaposed to a centrally located spring anchor surface 56 which is also presented from the spring support 530.

An interactive spring 60 is centrally positioned on the spring support 530 intermediately with respect to the rigid connecting plates 513. The interactive spring 60 may be attached to the spring support 530 in the same manner described in conjunction with chair assemblies 12 and 312. That is, a mounting plate 42 is disposed to overlie the first end portion 64 of the interactive spring 60, and a pair of threaded fasteners 44 are inserted through appropriate openings provided in the mounting plate 42, through registered bores in the first end portion 64 of the interactive spring 60 and into one or more receiving bores (not shown in FIG. 18) in the central anchor surface (also not shown in FIG. 18).

The interactive spring 60, which is located between the laterally spaced, rigid connecting plates 513, is vertically aligned with the central slideway 50 on the spring support 530. The interactive spring 60 extends generally rearwardly and upwardly from the central anchor surface 56. As such, the interactive spring 60 is cantilevered outwardly from the central anchor surface 56 to which the first end portion 64 of the interactive spring 60 is secured. The second end portion 68 of the interactive spring 60 is, therefore, unsupported, but as described in conjunction with FIG. 6, the interactive spring 60 overlies the upwardly facing, curvilinearly contoured surface 54 on the movable wedge member 52. By selectively positioning the wedge member 52 with respect to the interactive spring 60 the flexure characteristics of the interactive spring 60 may be adjusted, as desired, and as heretofore explained.

The seat pan 72 in chair assembly 512, as depicted in FIGS. 4 and 11, also has a pair of mounting blocks 80 each having a bearing surface in the configuration of a semi-cylindrical saddle 82 to which a stanchion 590 may be pivotally mounted. As such, the back supporting portion 18 employed in chair assembly 512 also incorporates a stanchion 590 which has a pair of S-curved support arms 98 which are laterally spaced to lie on either side of the seating portion 16 and which extend between a base portion 586 to a transverse support bar 100 from which the back cushion assembly 102 may be presented.

Similarly to the suspension mechanism 10 utilized with chair assembly 12, the base portion 586 of the stanchion 590 utilized in chair assembly 512 has a pair of lever arms 122 that are disposed laterally with respect to the sagittal plane of the chair assembly 512. The outer end portion of each lever arm 122 terminates in a hook 126 that is adapted to receive a rod-like axle 128 upon which a low friction follower, or drive wheel, 130 is rotatably mounted. The follower 130 is preferably aligned with the sagittal plane of the chair assembly 512. Details of this arrangement are shown and described in conjunction with FIG. 6. Specifically, the follower 130 preferably rests lightly against the interactive spring 60 when the chair assembly 512 is in the "at rest," or unoccupied, position.

The base portion 586 of the stanchion 590 also supports a primary back spring 140 in the manner depicted in FIG. 5 and as described in conjunction therewith. As such, end 144 of the primary back spring 140 is disposed in sliding engagement with the undersurface 146 of the seat pan 72.

At this point it may be repeated that the primary distinction between chair assembly 512 and the chair assemblies 12, 312 and 412 previously described herein is that the seating portion 16 is fixed with respect to the pedestal assembly 14 and cannot swing in response to the weight and movement of the person occupying the chair assembly 412.

A FOURTH ALTERNATIVE EMBODIMENT

Figure 19:
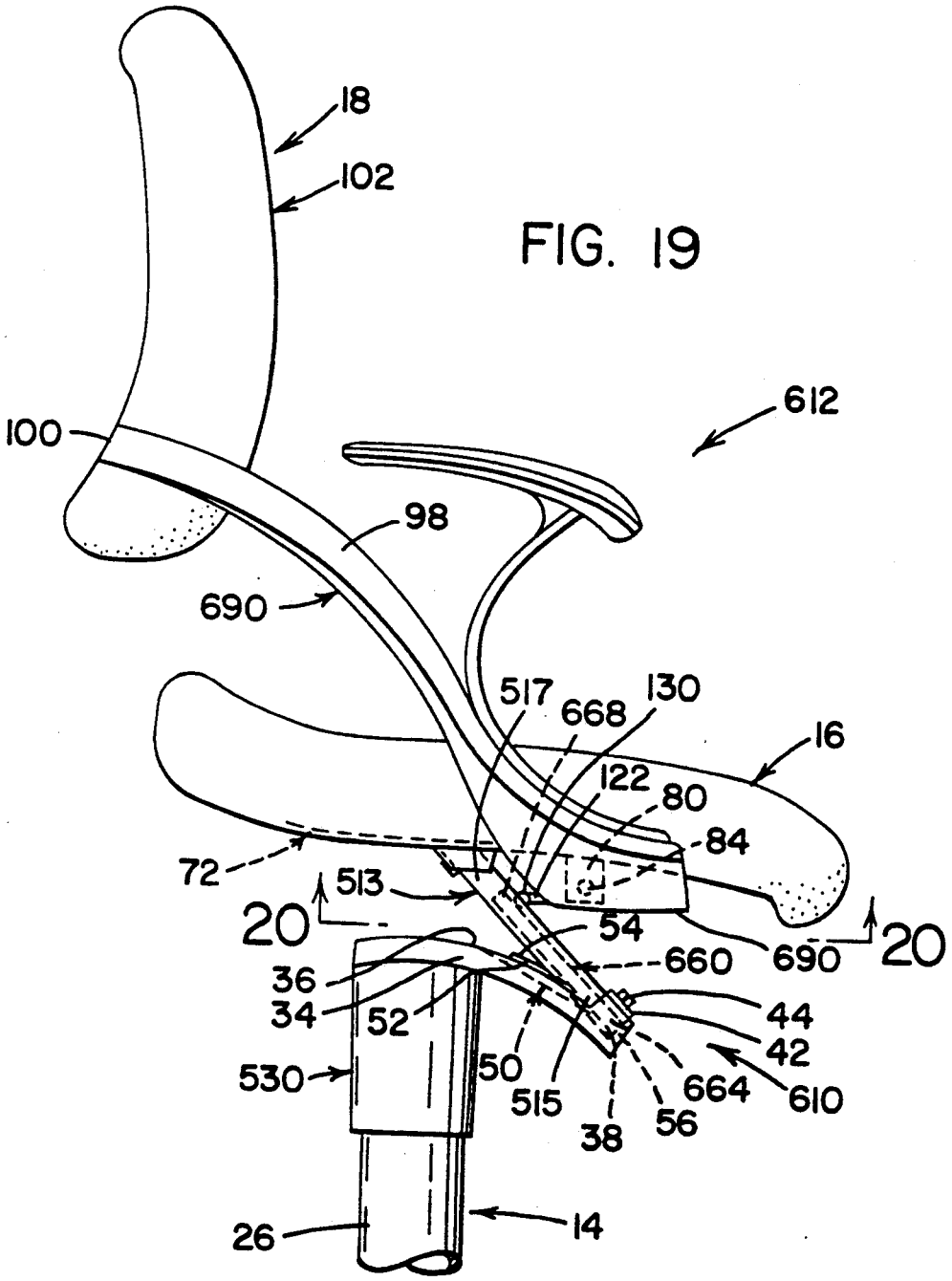
FIG. 19 is a view similar to FIG. 18, except that the tilting of the back supporting portion with respect to the seating portion is controlled by virtue of an enhanced interactive spring and without the use of a primary back spring.

With reference now to FIGS. 19 and 20, a fourth alternative embodiment of a suspension mechanism embodying the concepts of the present invention is identified generally by the numeral 610 and is incorporated in a chair assembly 612.

For convenience, those components utilized in the chair assembly 612 which may be identical to those components utilized in chair assemblies 12, 312, 412 and/or 512 will be designated by the same numerical identifiers utilized in those particular assemblies, and those components of chair assembly 612 which are different than, or which constitue distinct structural variations of, the corresponding, or similar, structural members in the previously described chair assemblies 12, 312, 412 and/or 512 will be identified by a three digit numerical identifier which begins with the numeral "6". As such, the suspension 610, is employed to secure the seating portion 16 with respect to the pedestal assembly 14 and yet allow the back supporting portion 18 to swing with respect to the seating portion 16, for substantially the same results accomplished with chair assembly 512, but with a lesser number of components than employed with chair assembly 512.

The pedestal assembly 14 of the suspension mechanism 610 also includes a cylindrical post 26 on the top of which a spring support 530—which may be identical with that employed in suspension mechanism 510—may be secured. As with chair assembly 512, the spring support 530 has a pair of laterally spaced ramps 34, and the upwardly facing surface 36 on each ramp 34 merges into an anchor surface 38.

As with chair assembly 512, in chair assembly 612 one of the laterally spaced, substantially rigid, connecting plates 513 may be secured to each of the laterally spaced anchor surfaces 38. To effect attachment of each connecting plate 513A and 513B to its respective anchor surface 38, individual mounting plates 42 and threaded fasteners 44 may be employed as described in conjunction with chair assembly 512. It should be appreciated, however, that because of the rigid nature of the connecting plate 513 the threaded fasteners may not require the utilization of a mounting plate 42 to secure the end portion 515 of each connecting plate 513.

When properly secured to the anchor surfaces 38, each of the connecting plates 513 extends generally rearwardly and upwardly from the respective, laterally spaced anchor surfaces 38. The second end portion 517 of each connecting plate 513 may also be connected to the seat pan 72 in the seating portion 16 of the chair assembly 612 at the anchor surfaces 74 in the manner shown and described in conjunction with FIG. 20. As such, the seating portion 16 is securely anchored to the pedestal assembly 14 such that any relative movement between the seating portion 16 and the pedestal assembly 14 is precluded.

Similarly to the arrangement depicted in FIG. 6, a central slideway, or recess, 50 is provided between the anchor surface 38 on the spring support 530 to house a movable, selectively positionable, wedge member 52. The upwardly facing surface 54 on the movable wedge member 52 is curvilinearly contoured and may be juxtaposed to a centrally located spring anchor surface 56 which is also presented from the spring support 530.

An enhanced, interactive spring 660 is centrally positioned on the spring support 530 intermediately with respect to the rigid, connecting plates 513. The enhanced interactive spring 660 may be attached to the spring support 530 in the same manner described in conjunction with chair assemblies 12, 312 and 512. That is, a mounting plate 42 is disposed to overlie the first end portion 664 of the interactive spring 660, and a pair of threaded fasteners 44 are inserted through appropriate openings provided in the mounting plate 42, through registered bores in the first end portion 664 of the interactive spring 660 and into one or more receiving bores (not shown) in the central anchor surface 56.

The interactive spring 660, which is located between the laterally spaced, rigid connecting plates 513A and 513B, is vertically aligned with the central slideway 50 on the spring support 530. The interactive spring 660 extends generally rearwardly and upwardly from the central anchor surface 56. As such, the interactive spring 660 is cantilevered outwardly from the central anchor surface 56 to which the first end portion 664 of the interactive spring 660 is secured. The second end portion 668 of the interactive spring 660 is, therefore, unsupported, but as described in conjunction with FIG. 6, the interactive spring 60—here the enhanced, interactive spring 660—overlies the upwardly facing, curvilinearly contoured surface 54 on the movable wedge member 52. By selectively positioning the wedge member 52 with respect to the interactive spring 660 the flexure characteristics of the interactive spring 660 may be adjusted, as desired, and as heretofore explained in conjunction with the interactive spring 60.

The seat pan 72 in chair assembly 612, as in chair assembly 512, also has a pair of mounting blocks 80 each having a bearing surface in the configuration of a semicylindrical saddle 82 to which a stanchion 690 may be pivotally mounted, preferably in the same, or a similar, manner, as depicted in FIGS. 4 and 11. As such, the back supporting portion 18 employed in chair assembly 612 also incorporates a stanchion 690 which has a pair of S-curved support arms 98 which are laterally spaced to lie on either side of the seating portion 16 and which extend between a base portion 686 to a transverse support bar 100 from which the back cushion assembly 102 may be presented.

Similarly to the suspension mechanism 10 utilized with chair assembly 12, the base portion 686 of the stanchion 690 utilized in chair assembly 612 has a pair of lever arms 122 that are disposed laterally with respect to the sagittal plane of the chair assembly 612 and from which a low friction follower, or drive wheel, 130 is rotatably mounted. The follower 130 is preferably aligned with the sagittal plane of the chair assembly 612. Details of this arrangement are shown and described in conjunction with FIG. 6. In this embodiment, as well, the follower 130 preferably rests lightly against the enhanced, interactive spring 660 when the chair assembly 612 is in the "at rest," or unoccupied, position.

At this point it should be appreciated that the primary distinction between chair assembly 612 and chair assembly 512 is that whereas the stanchion 690 does swing with respect to the seating portion 16 in response to the weight and movement of the person occupying the chair assembly 612 that movement is controlled solely by virtue of the interaction between the follower 130 and the interactive spring 660. For that reason the interactive spring 660 is preferably enhanced. Enhancement may be accomplished the use of an interactive spring 660 having a larger spring constant, as represented by the relatively thicker cross section thereof depicted in FIG. 20. Inasmuch as the swinging movement of the back supporting portion 18 is determined solely by virtue of the enhanced interactive spring 660, the interactive spring 660 is fully operative by engagement of the follower 130 therewith in order to flex the interactive spring 660 upon tilting of the back supporting portion 18 with respect to the seating portion 16.

As should now be apparent, the present invention not only teaches that an improved suspension mechanism can be provided for attaching the seating portion as well as the back supporting portion of a chair to a pedestal assembly but also that the other objects of the invention can likewise be accomplished.

We claim:

1. A suspension mechanism for connecting the seating and back supporting portions from the pedestal assembly in a chair, the suspension mechanism comprising:

a support means carried by an upper end portion of the pedestal assembly;

a substantially rigid connecting plate having first and second ends;

said first end of said connecting plate secured to said support means;

a seating portion;

said second end portion of said connecting plate secured to said seating portion;

a stanchion rotatably connected to said seating portion;

back supporting means attached to said stanchion;

a primary back spring operatively interacting between said stanchion and said seating portion;

an interactive spring being secured to said support means and being cantilevered outwardly therefrom; and, follower means attached to said stanchion operatively to engage said cantilevered, interactive spring.

2. A suspension mechanism, as set forth in claim 1, wherein the suspension mechanism further comprises:

a spring engaging wedge member selectively positionable on said support means and having a curvilinearly contoured surface;

means selectively to position said wedge member on said support means; and said interactive spring progressively engaging said curvilinearly contoured surface on said wedge member progressively to alter the flexure characteristics of said interactive spring.

3. A suspension mechanism, as set forth in claim 1, wherein:

said back spring and said interactive spring are made of fiber reinforced plastic.

* * * * *